US006551011B1

(12) United States Patent
Valentine

(10) Patent No.: US 6,551,011 B1
(45) Date of Patent: Apr. 22, 2003

(54) HIGHWAY MEDIAN BARRIER AND PARAPET

(76) Inventor: Heath E. Valentine, Valentine & Company, 3925 Roosevelt Blvd., Middletown, OH (US) 45055

( * ) Notice: Subject to any disclaimer, the term of this patent is extended or adjusted under 35 U.S.C. 154(b) by 0 days.

(21) Appl. No.: 09/721,476

(22) Filed: Nov. 22, 2000

Related U.S. Application Data

(60) Provisional application No. 60/166,880, filed on Nov. 22, 1999.

(51) Int. Cl.[7] ..... E01F 13/00
(52) U.S. Cl. ..... 404/6; 404/9; 256/13.1
(58) Field of Search ..... 256/1, 13.1; 404/6, 404/9, 10

(56) References Cited

U.S. PATENT DOCUMENTS

| | | | | | |
|---|---|---|---|---|---|
| 3,233,352 | A | * | 2/1966 | Projector et al. | 256/13.1 |
| 3,708,988 | A | * | 1/1973 | Miura | 256/1 |
| 3,944,187 | A | * | 3/1976 | Walker | 256/13.1 |
| 3,966,173 | A | * | 6/1976 | Glaesener | 256/13.1 |
| 4,104,980 | A | | 8/1978 | Toomey | 116/63 P |
| 4,376,594 | A | | 3/1983 | Prosenz | 404/6 |
| 4,496,264 | A | | 1/1985 | Casey | 404/6 |
| 4,553,875 | A | | 11/1985 | Casey | 404/6 |
| 4,722,513 | A | | 2/1988 | Gaillard et al. | 256/13.1 |
| 4,852,511 | A | | 8/1989 | Look et al. | 116/63 P |
| 5,074,705 | A | | 12/1991 | Schmitt | 404/6 |
| 5,104,254 | A | * | 4/1992 | Durand | 404/6 |
| 5,217,318 | A | | 6/1993 | Peppel | 404/6 |
| 5,230,582 | A | | 7/1993 | Schmitt et al. | 404/6 |
| 5,531,540 | A | | 7/1996 | Wasserstrom et al. | 404/6 |
| 5,713,694 | A | | 2/1998 | Monda et al. | 404/9 |

FOREIGN PATENT DOCUMENTS

| | | | | |
|---|---|---|---|---|
| DE | 3333037 A1 | * | 4/1985 | E01F/15/00 |
| DE | 3827030 A1 | * | 4/1989 | E01F/15/00 |
| EP | 0452893 A1 | * | 4/1991 | E01F/9/08 |
| GB | 2124280 A | * | 6/1982 | E01F/9/01 |

OTHER PUBLICATIONS

Drawing–Dow 1–Piece Face; date unkown; admitted to be prior art for the limited purpose of consideration of this reference as prior art in the prosecution of this application; applicant reserves the right to challenge the status of this reference as prior art.

Drawing–Magnode 2–Piece Face; date unknown; admitted to be prior art for the limited purpose of consideration of this reference as prior art in the prosecution of this application; applicant reserves the right to challenge the status of this reference as prior art.

Article, "Fabricated Posts", Design systems by states for ALCOA Highway Bridge Railing Assemblies, pps. 48,52, 53,57,69, 1970.

* cited by examiner

*Primary Examiner*—Thomas B. Will
*Assistant Examiner*—Alexandra K. Pechhold
(74) *Attorney, Agent, or Firm*—Thompson Hine LLP

(57) ABSTRACT

A parapet for mounting on a deck and resisting applied loads comprising a base plate located on the deck and a post coupled to the base plate and extending generally upwardly from the deck. The parapet further includes a lower panel extending from base plate to the post such that the post, the base plate and the lower panel form a triangular truss for resisting applied loads.

47 Claims, 31 Drawing Sheets

HIGHWAY MEDIAN BARRIER AND PARAPET

This application claims priority to U.S. Provisional Application Ser. No. 60/166,880, filed Nov. 22, 1999, the contents of which are hereby incorporated by reference.

The present invention is directed to a highway barrier and parapet and a method for assembling a highway barrier and parapet.

BACKGROUND OF THE INVENTION

In highway and roadway construction, a median barrier or barriers is often attached to a bridge or road surface to separate various lanes of traffic. The bridge or roadway may also include a parapet or parapets located on the outer edges of bridge or road surface to protect pedestrians from traffic and maintain traffic on the bridge. The median barriers and parapets may be a "safety shape" system, which are median barriers or parapets having a profile that allows smooth mounting and demounting of a vehicle along the lower edges of the barrier or parapet. An example of such safety shape median barrier systems are metal median barriers are manufactured by Dow Chemical Company of Midland, Mich. and by Magnode Products Company of Trenton, Ohio.

Safety shape median barriers and parapets usually have a generally smooth, continuous outer surface. The outer surface has a lower edge forming an angle with, and located adjacent to, the road surface. When a vehicle veers off the roadway and onto the safety shape median barrier or parapet, a wheel or wheels of the vehicle ride up on the lower edge of the median barrier or parapet. As the vehicle continues to ride up the median barrier or parapet, the vehicle is guided upwardly and rotated away from the barrier by the shape of the barrier or parapet. The upward and rotational movement of the vehicle converts some of the lateral energy of the vehicle into a vertical component which can be absorbed by the vehicle springs. The safety shape median barriers or parapets are also shaped to smoothly guide the vehicle from the median barrier or parapet back onto the roadway.

The existing safety shape median barriers and parapets, while most frequently made of concrete, can also be made of extruded metal panels that are attached to vertically extending posts, and are particularly used on bridges or other elevated roadways. Most existing metal safety shape parapet or median barrier systems are installed by aligning pre-drilled holes in the panels with pre-drilled holes in the posts, and then passing a fastener through the aligned holes. However, it is difficult and time consuming to align the predrilled holes, as the panel elements may be warped or distorted, the posts may not be precisely located in the desired location, and/or the dimensions of the posts and panels may vary due to thermal expansion or contraction. Another drawback with existing median barrier and parapet systems is that the panels include access holes through which the fasteners are passed to enable assembly of the system. These access holes are unsightly and can allow debris or wildlife to enter the barrier or parapet.

During installing of existing highway safety shape median barriers or parapets, a foot piece is typically coupled to the deck. Several bolts are passed through the foot piece to attach the foot piece to the deck. The panels are then slid laterally into a slot in the foot pieces to couple the panel and the foot pieces together. However, sliding the panels into the foot pieces can be difficult and time consuming due to the size of the panels, friction between the panels/foot pieces and warping or distortion of the materials. Furthermore, once the panel is coupled to the foot piece in this manner, the panel typically blocks access to the bolts that couple the foot piece to the deck, which increases assembly time.

A further drawback with many prior art safety shape median barrier and parapet systems is that they are intermittent; that is, there are regularly spaced discontinuities along the length of the system. Because most prior art safety shape median barrier systems rely upon the alignment of pre-drilled holes, as more panels are mounted it becomes increasingly difficult to mount the panels to the posts due to the accumulated out-of-range tolerances. Accordingly, it is often necessary to create a break in the system (i.e., a discontinuity) in a vertical plane. A new post is then mounted adjacent to the existing post, and a new section of panels are restarted to reset the out-of-tolerance measurements. However, the discontinuities formed by this method of construction may create areas of weakness at the discontinuities. Furthermore, the discontinuities create a series of discreet, structurally independent sections within the median barrier or parapet system. Each section has little ability to transfer impact loads to its adjacent sections, and therefore each section of the median barrier or parapet system stands alone when receiving an applied force.

In order to address this problem, metal plates may be bolted to the median barrier or parapet and located such that the plates extend over a discontinuity. Alternately or additionally, the median barrier or parapet may include an upper section of railing that bridges the discontinuity. While providing some segment-to-segment continuity, these measures do not significantly address the loss of continuity in such median barrier or parapet sections.

Accordingly, there is a need for a safety shape median barrier or parapet system that is easy to install, and provides flexibility during installation by accommodating variations in the dimensions and locations of various system components. There is also a need for a safety shape median barrier or parapet system that provides ready access to the bolts that attach the system to the deck, and that reduces the effect of vertical discontinuities in the system.

SUMMARY OF THE INVENTION

The present invention is a safety shape median barrier and a parapet system that is easy to install, accommodates size variations in various components, provides ready access to the mounting bolts during installation, and reduces the effect of vertical discontinuities in the system. More particularly, the present invention utilizes a plurality of panels, each panel including one or more channels shaped to receive a clamp bar therein. The clamp bars can be slid within the channels and mounted to a post or other structure by a fastener. Because the clamp bar is free to slide within the panels, the panels need not have pre-drilled holes. The channel/clamp bar system enables the panels to be attached to the posts or other structures at nearly any point along the length of the panel, and provides a high degree of flexibility to the installer. Because there is no buildup of out-of-range tolerances in the median barrier or parapet of the present invention, the median barrier or parapet can be installed as a substantially continuous system.

The various components of the present invention can be arranged such that discontinuities in a layer of components of the system are spanned by the structure of an adjacent component. In this manner, the system can be assembled so that there are no discontinuities that extend throughout the height of the median barrier or parapet system, which increases the strength of the median barrier or parapet.

In one embodiment, the present invention includes a plurality of base plates that are coupled to the bottom of the posts, and the base plates are shaped to receive the bottom of the lower panels. Because each base plate has a fixed distance between its outer edges and the post, the base plates precisely set the lateral spacing of the lower panels. In this matter, the tolerances in the system and the loading bearing characteristics of the system can be tightly controlled. The base plates also help to transmit applied loads into tensile and compressive forces to improve the load bearing characteristic of the median barrier or parapet system.

In another embodiment, the present invention also includes a support element that receives a panel therein to couple the panel to the deck. The support element is attached to the deck by one or more bolts, and includes an inwardly opening end surface that receives a lower flange of the panel therein. The support element enables the panel to rotate out of the vertical plane of the mounting bolt and thereby provides access for tightening of the bolt.

In one embodiment, the invention is a parapet for mounting on a deck and resisting applied loads comprising a base plate located on the deck and a post coupled to the base plate and extending generally upwardly from the deck. The parapet further includes a lower panel pivotably coupled to the base plate and the lower panel form a triangular truss for resisting applied loads.

Accordingly, it is an object of the present invention to provide a median barrier or parapet that is easy to install, robust, can accommodate variations in size of its various components, and reduces the effects of any discontinuities. Other objects and advantages of the present invention will be apparent from the following description and the accompanying drawings.

DETAILED DESCRIPTION

Figure 1:
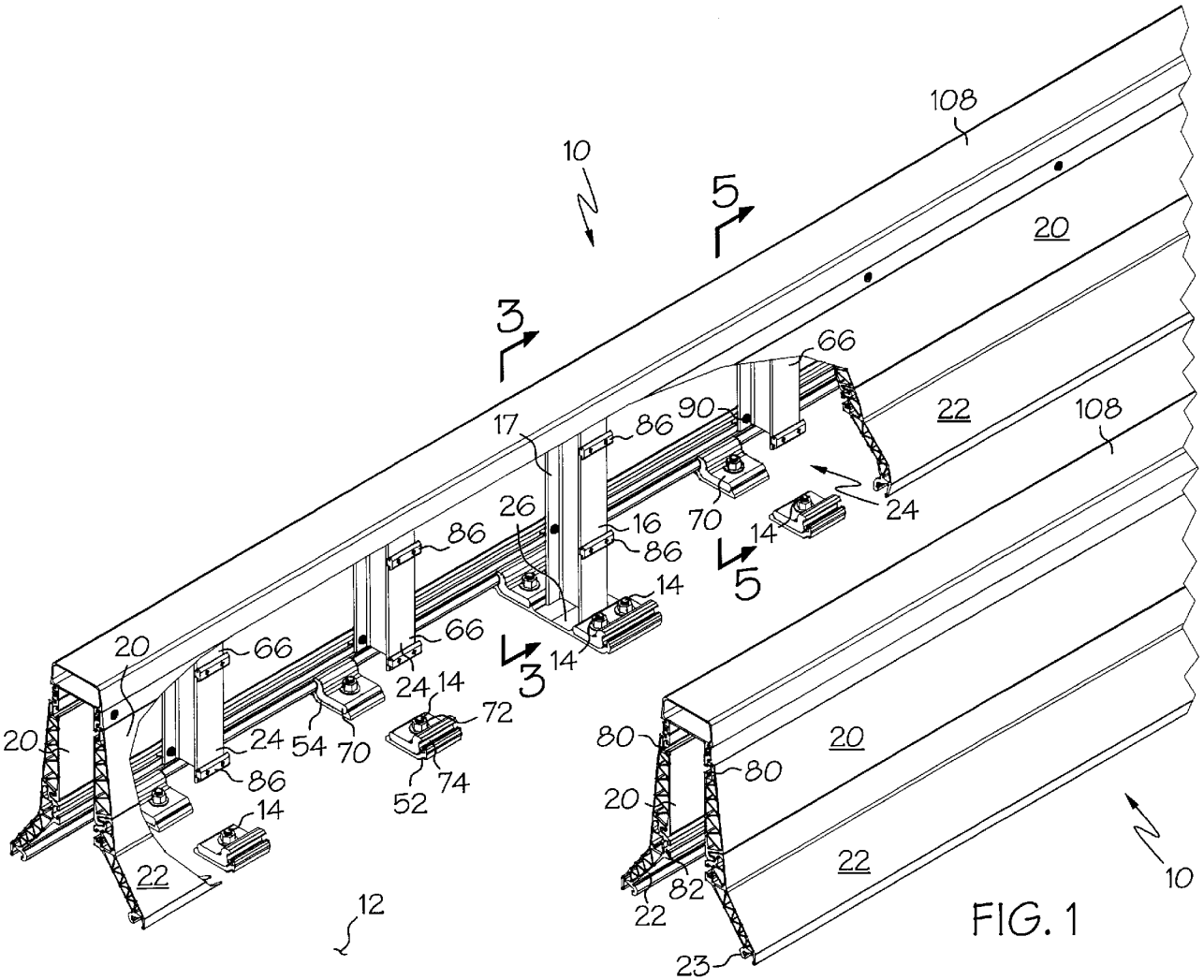
FIG. 1 is a perspective partial cut away view of a preferred embodiment of the median barrier of the present invention.
Figure 2:
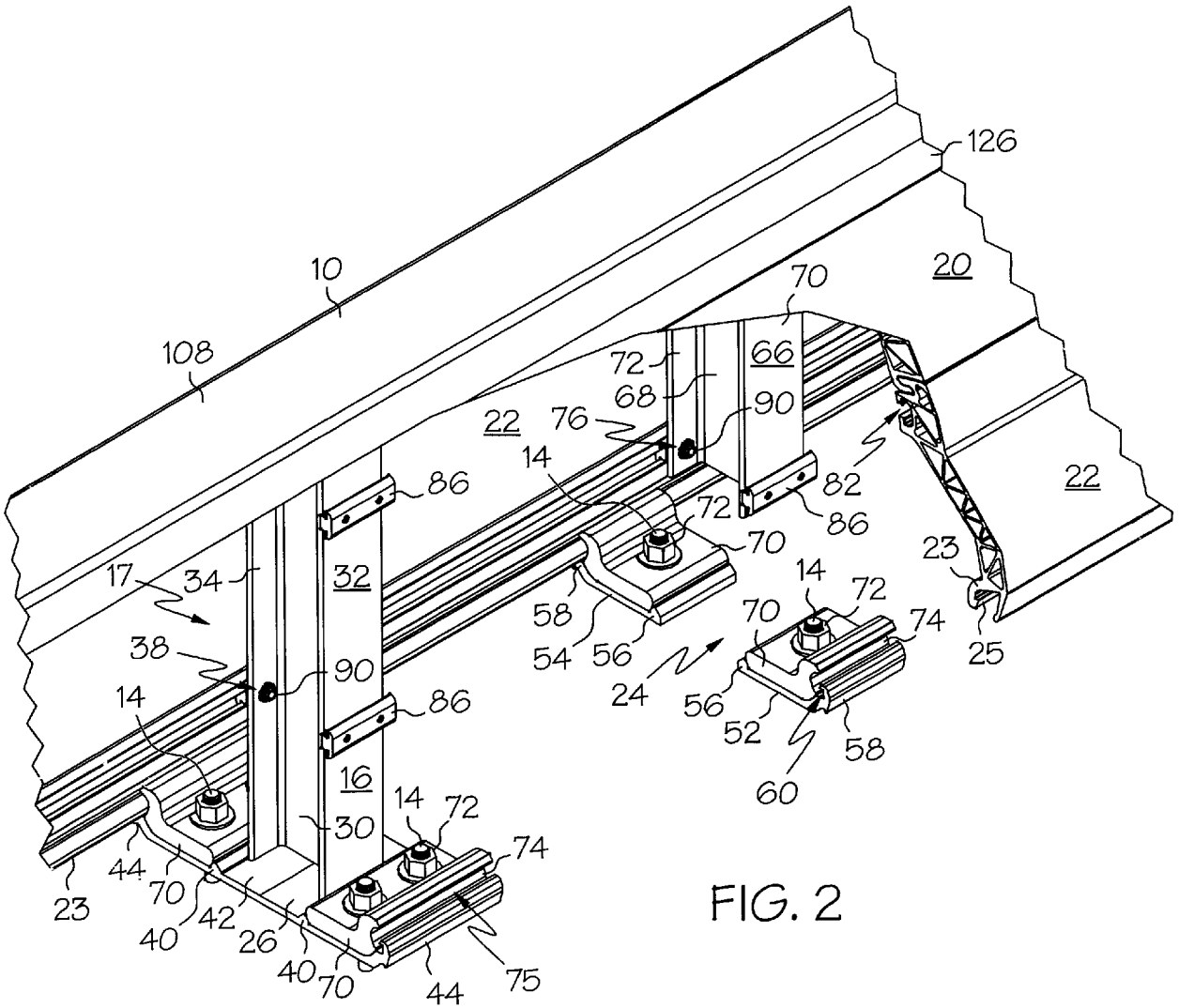
FIG. 2 is a detail of part of the median barrier of FIG. 1.
Figure 3:
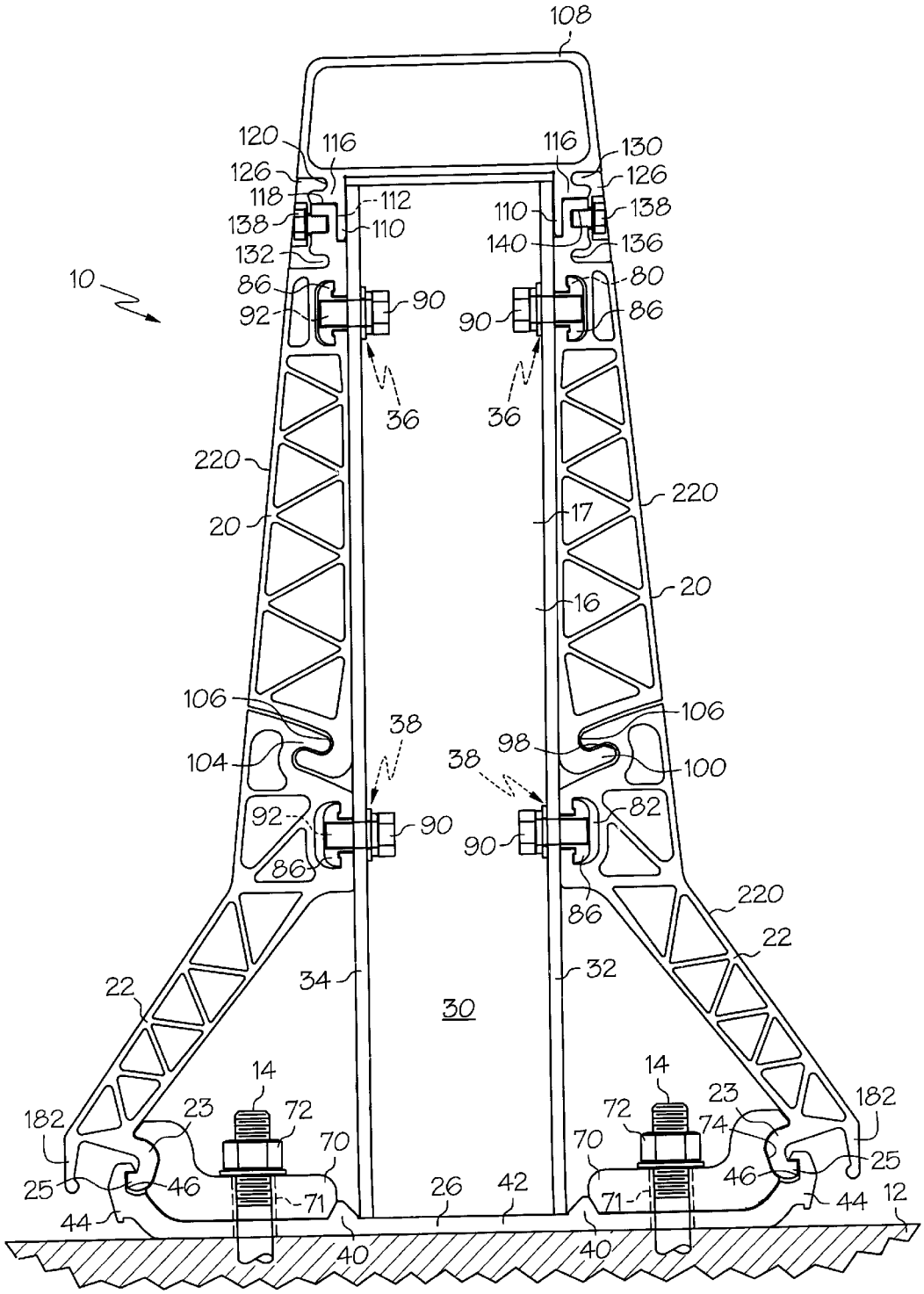
FIG. 3 is an end cross section of the median barrier of FIG. 1, taken along lines 3—3 of FIG. 1.
Figure 4:
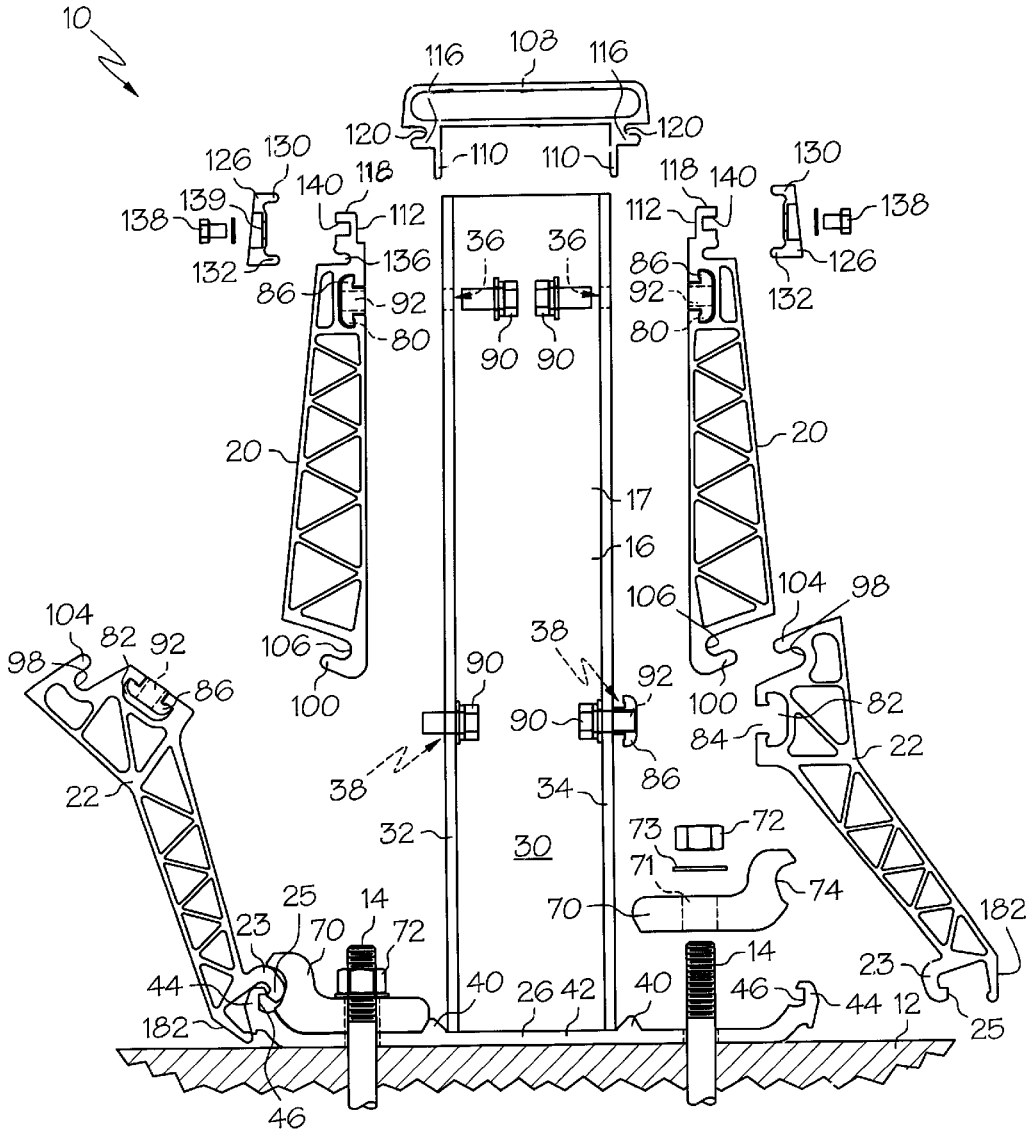
FIG. 4 is an exploded view of the median barrier of FIG. 3, with an alternate top cap.

As best shown in FIGS. 1–5, the median barrier of the present invention, generally designated 10, is designed sit on top of the road surface, earth, or deck 12, and extends longitudinally along the deck. Although the term "deck" is used throughout this application, it should be understood that the term deck means any surface upon which the median barrier or parapet of the present invention can be mounted, including roadways, bridges, concrete structures, earth, etc. A plurality of mounting bolts 14 extend upwardly from the deck 12, and the median barrier 10 is coupled to the mounting bolts 14 to couple the median barrier to the deck 12. The median barrier 10 is preferably made of metal, such as aluminum, and includes a plurality of posts 16 that extend down to the road surface, and a plurality of upper panels 20 and lower panels 22 are coupled to either side of the post 16 to form the mediam barrier 10. A plurality of intermediate bases 24 are located between each post 16, and a plurality of upper panels 20 and lower panels 22 are coupled to either side of the intermediate bases and posts. As best shown in FIG. 3, each lower panel 22 includes a lower flange 23 that includes a generally outwardly extending lip 25. As best shown in FIG. 4, the lower panels 22 include a groove 98 that receives a tab 100 of the upper panel 20 therein such that the upper 20 and lower 22 panels are interfit together. The lower panel 22 also includes a tab 104 that is received in a groove 106 in the upper panel 20.

As best shown in FIG. 2, the post 16 may include a base plate 26 at the bottom of the post, and the post 16 is preferably welded to the base plate 26 to form a post/base plate combination 17. Each post 16 is a generally vertically extending I-beam, channel, or other similar structure and in the illustrated embodiment the post 16 has a central web 30 and two end flanges 32, 34. The flange 32 includes a pair of upper holes 36 and a pair of lower holes 38 (FIG. 4). Similarly, the end flanges 32, 34 each include a pair of upper holes 36 and a pair of lower holes 38. For each set of holes 36, 38, one hole is located on one side of the central web 30 and the other hole is located on the other side of the central web.

Figure 7A:
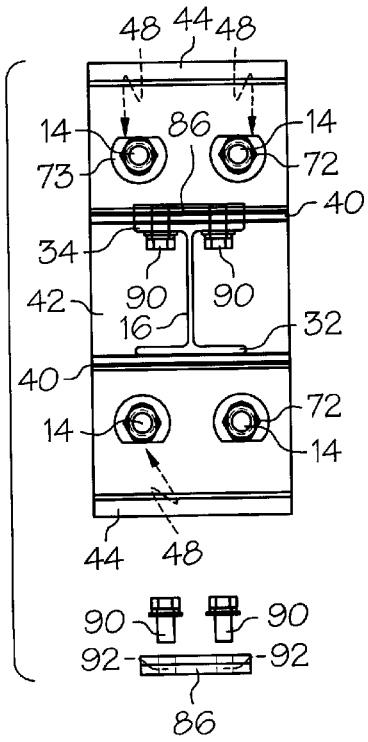
FIG. 7A is a partially exploded top view of a post and base plate used with the median barrier of FIG. 1, coupled to the deck.
Figure 7B:
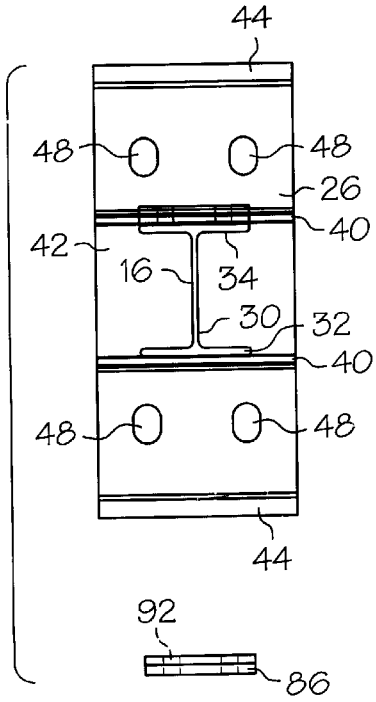
FIG. 7B is a partially exploded top view of a post and backing plate used with the median barrier of FIG. 1.

The base plate 26 includes a pair of upwardly-extending projections 40, a center portion 42 located between the two projections 40, and a pair of generally upwardly-extending ridges 44 at each outer end of the base plate. Each ridge 44 has an inwardly facing notch 46 formed therein. As shown in FIG. 7B, each base plate 26 includes a set of elongated slots 48, each slot 48 being shaped to receive a mounting bolt 14 therethrough. As will be discussed in greater detail below, the elliptical or oval shape of the holes 48 provides tolerance for any misalignment of the posts 16.

Figure 5:
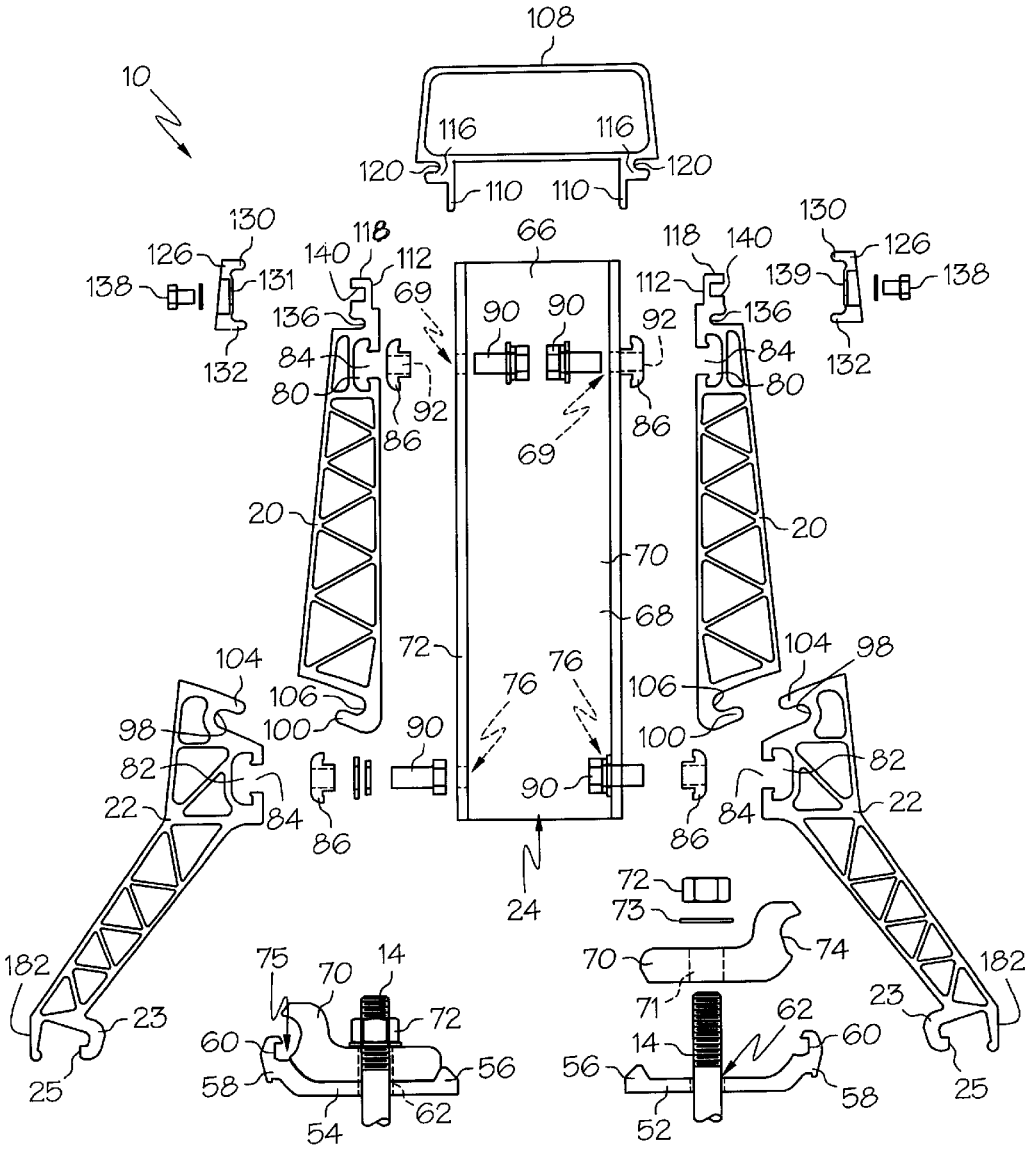
FIG. 5 is an exploded end cross section of the median barrier of FIG. 1, taken along lines 5—5.
Figure 6A:
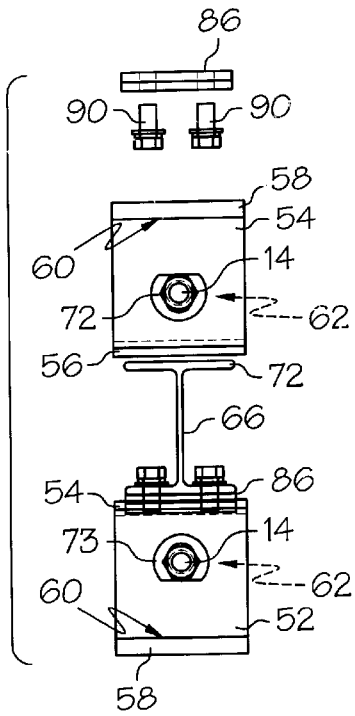
FIG. 6A is a partially exploded top view of an intermediate base used with the median barrier of FIG. 1, and coupled to the deck.
Figure 6B:
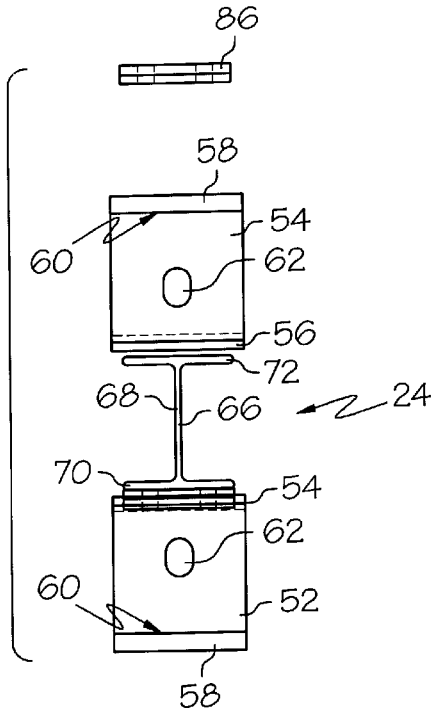
FIG. 6B is a partially exploded top view of an intermediate base used with the median barrier of FIG. 1.

As shown in FIG. 6B, each of the first and second support elements 52, 54 similarly includes a set of elongated slots 62 therein, and the support elements 52, 54 can be attached to the deck 12 by passing a mounting bolt 14 through each slot 62 in the same manner as the base plates 26 (see FIG. 5). Each support element 52, 54 may also include more than one slot 62, such as the embodiment in FIG. 2 wherein each support element 52, 54 includes two slots 62. Each intermediate base 24 includes a backing post 66 located above each corresponding support element 52, 54. Each backing post 66 is an I-beam similar to the post 16, and includes a central web 68, a pair of end flanges 70, 72 and a pair of upper 69 and lower 76 holes formed in each of the end flanges 70, 72 (FIG. 5). The backing post 66 is similar to a post 16, but does not extend down to the deck 12.

Figure 17:
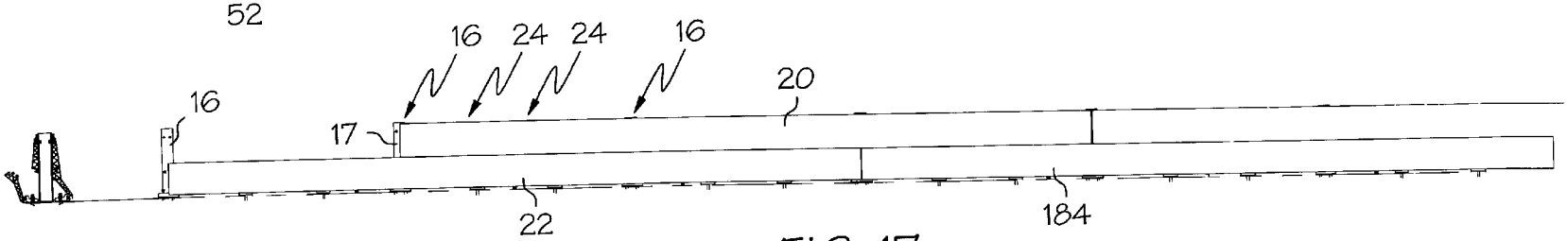

As shown in FIG. 1, a number of intermediate bases 24 are located between each post 16. In the embodiment shown in FIG. 2, three intermediate bases 24 are located between each post 16; in the embodiment shown in FIG. 17, two intermediate bases are located between each post. As shown in greater detail in FIGS. 2 and 5, each intermediate base 24 includes a first support element 52 and second support element 54, and each intermediate base 24 therefore lacks the center portion 42 of the base plates 26. Each support element 52, 54 includes a projection 56 at its inner edge that corresponds to the projection 40 on base plate 26. Each support element 52, 54 includes a ridge 58 at its outer edge, each ridge 58 having a notch 60 formed therein and goes to the ridges 44 of the base plate 26.

As best shown in FIG. 2, the median barrier 10 includes a plurality of toe clips 70 located on top of the base plate 26 and each support element 52, 54. Each toe clip 28 is located between a projection 40 and a ridge 44 on a base plate 26 which serves to locate the toe clips 70 on the base plate 26. Similarly, on each support element 52, 54, each toe clip 70 is located between a projection 56 and ridge 58 . Each toe clip 70 includes an opening or openings 71 extending therethrough. In order to couple a toe clip 70 to the median barrier 10, the toe clip 70 is located over a base plate 26 or support element 52, 54 such that the mounting bolts 14 extending through the base plate or support element 52, 54 are received through the opening 71 of the toe clip 70. A threaded fastener 72 is then threaded onto the mounting bolts 14. The mounting bolts 14 and fastener 72 also couple the base plates 26 and support elements 52, 54 to the deck 12.

As best shown in FIGS. 4–5, each toe clip 70 includes an open end 74 that receives/engages the lower flange 23 of a lower panel 22. Thus, each toe clip 70 and its associated ridge 44, 58 define an opening 75 therebetween (See FIG. 5) for receiving the lower flange 23 of a lower panel 22. Because each toe clip 70 receives a lower panel 22 against its open end 74, the projections 40, 56 (via the toe clips 70) also help to determine the location of the lower panels 22 (that is, the left-to-right location of the lower panels 22 in FIG. 3). As will be discussed in greater detail below, the intermediate bases 24 and support elements 52, 54 also restrain the lower panels 22 from lateral movement during impact forces applied by vehicles or other means. The intermediate bases 24 also provide points for the panels 20, 22 to absorb tensile loads, which enables the median barrier to resist rotational forces upon impact of a vehicle.

As shown in FIG. 3, the lip 25 of the lower flange 23 of each lower panel 22 is captured between the open end 74 of each toe clip 70 and the ridge 44 of the associated base plate 26. The lip 25 of each lower panel 22 is also received in a notch 46 of any associated base plates 26. Because the distance between the ridges 44 is fixed by the base plate 26, the base plate 26 sets the lateral spacing of the lower ends of opposed lower panels 22. That is, at every post/base plate combination 17 location, the spacing of the lower end of each lower panel 22 relative to its opposed lower panel is controlled by the base plate 26, which helps to align the median barrier 10 at regularly spaced intervals. Furthermore, as shown in FIGS. 2 and 5, each support element 52, 54 is bolted to the deck 12 at each intermediate base 24. Accordingly, the lateral spacing between the lower edges of each opposed lower panel 22 is also controlled at each intermediate base 24 location.

As best shown in FIG. 5, the upper panels 20 and lower panels 22 may be made from an extruded, webbed material, such as aluminum. Each upper panel 20 includes a channel 80 extending through the length of the panel 20, and each lower panel 22 similarly includes a channel 82 extending through the length of the panel. Each channel 80, 82 includes a narrowed throat portion 84, and is shaped to slidingly receive one or more clamp bars 86 therein. Each clamp bar 86 is shaped to fit within a channel 80, 82 such that the clamp bar 86 can be passed into a channel 80, 82 at the end of each panel 20, 22, but the clamp bar 86 cannot be pulled through a throat 84 of the channel 80, 82.

Figure 9:
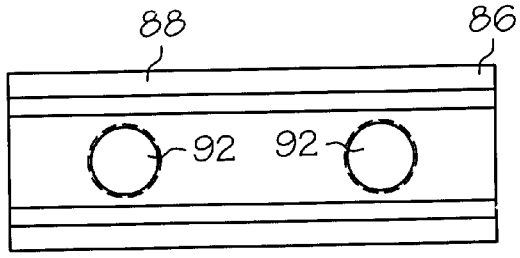
FIG. 9 is a front view of a clamp bar used with the present invention.
Figure 10:
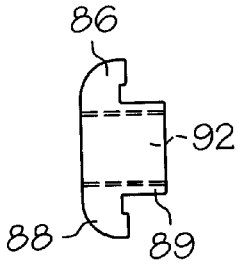
FIG. 10 is an end view of the clamp bar of FIG. 9.

As shown in FIGS. 9–10, each clamp bar 86 is generally "mushroom shaped" in end view and includes a head portion 88 and a neck portion or shank 89. Each clamp bar 86 includes a pair of threaded holes 92 that can be aligned with a corresponding set of upper 36 and lower 38 holes located in a post 16 (FIG. 7), or aligned with a set of upper 69 or lower 76 holes of a backing post 66 (FIG. 5). A fastener or fasteners 90 can then be passed through the holes 69, 76, or 36, 38 with which the clamp bar is aligned. The fasteners 90 are received in the holes 92 of the clamp bar 86 to couple the associated upper or lower panel 20, 22 to the backing post 66 or post 16. Because the clamp bars 86 are received in the channels 80, 82 of the upper 20 and lower 22 panels, the upper and lower panels 20, 22 are thereby coupled to the posts 16, and the vertical motion of the panels 20, 22 relative to the posts 16 is restrained. As will be discussed in greater detail below, this method of attaching the upper and lower panels 20, 22 to the posts 16 and backing posts 66 provides the installer great flexibility due to the ability of the clamp bars 86 to slide laterally within the channels 80, 82.

The median barrier 10 preferably includes a top cap 108 located on top of the upper panel 20. As best shown in FIG. 5, the top cap 108 includes a pair of downwardly-extending flanges 110 received in a corresponding notch 112 in each upper panel 20. The top cap 108 also includes a pair of horizontally-extending ledges 116 that are received on the top edge 118 of the upper panels 20. Finally, the top cap 108 includes a pair of opposed grooves 120. In order to couple the top cap 108 to the upper panel 20, the top cap 108 is loosely placed on the upper panel 20 such that the flanges 110 are received in the notches 112 and the ledges 116 rest on to the top edges 118 of the upper panels 20. Next, and a pair of side rails 126 are coupled to the upper panels 20 and top cap 108 to complete the assembly. Each side rail 126 includes an upper flange 130 and a lower flange 132. The upper flange 130 is received in a groove 120 of the top cap 108, and the lower flange 132 is received in a groove 136 in an upper panel 20.

A plurality of fasteners 138 are then passed through an opening 139 in the side rails 126 and received into a slot 140 in the associated upper panel 20 to secure the side rails 126 to the panels 20. The longitudinally extending slot 140 preferably has a running thread into which the fasteners 138 may be screwed. This provides the installer flexibility as to where the fasteners 138 are screwed. Various sizes and shapes of the top cap 108, such as top cap 108' of FIG. 4, and other shapes, may be utilized to provide different shapes of the median barrier 10. For example, the top cap 108 may include structure for receiving flashers, signs, or lights.

A preferred method for installing one embodiment of the median barrier 10 will be described in detail below. However, it is to be understood that the described and illustrated method of installation is only one method that may be used to install the median barrier 10, and other methods and steps of installation may be utilized without departing from the scope of the invention. In particular, several of the steps described herein may be carried out in different sequence than that described herein, or in different manners, in order to achieve the same result.

Figure 11:
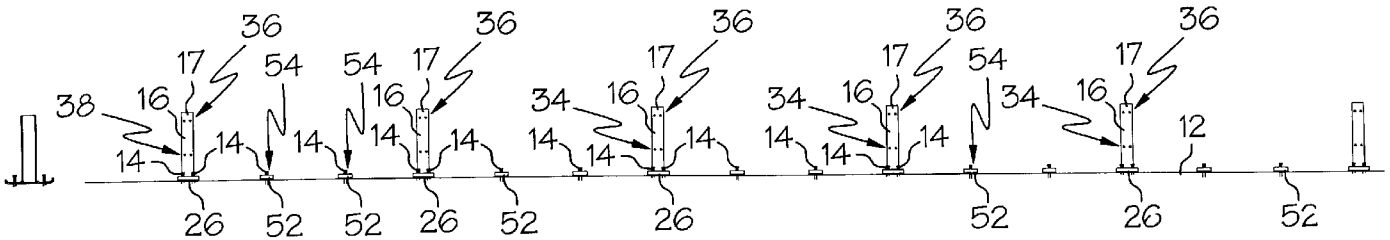
FIGS. 11–18 are a series of front views illustrating a preferred method for assembling the median barrier of FIG. 1.
Figure 18:
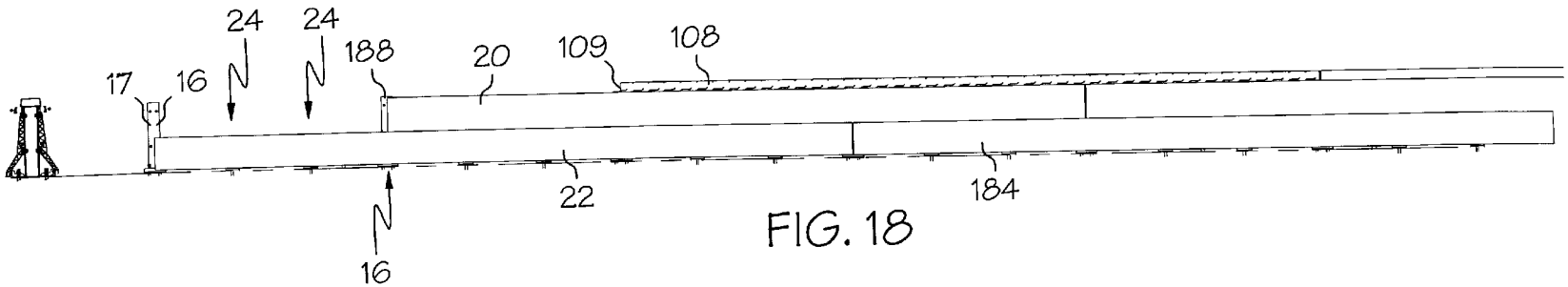
Figure 21:
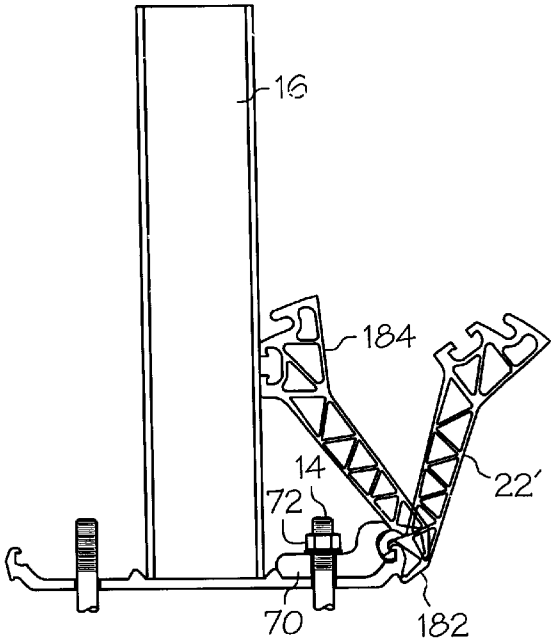
FIGS. 19–26 are a series of end cross section views illustrating a preferred method for assembling the median barrier of FIG. 1, and roughly corresponding to FIGS. 11–18.
Figure 20:
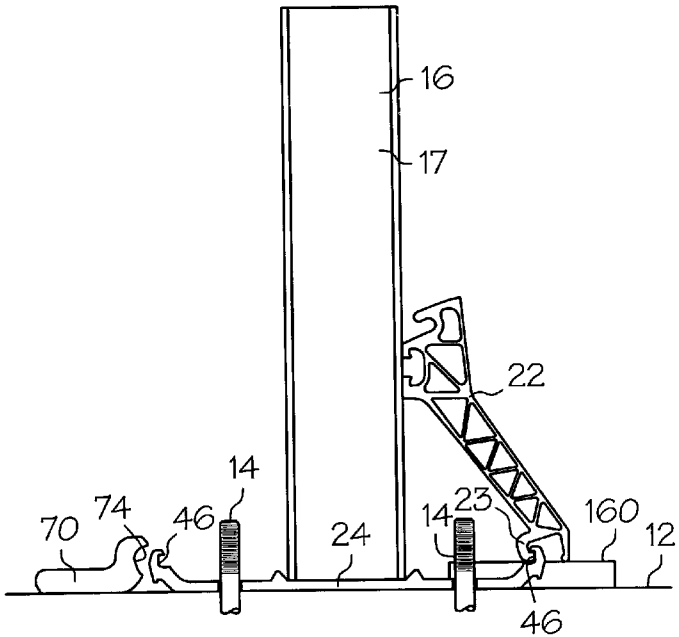
Figure 19:
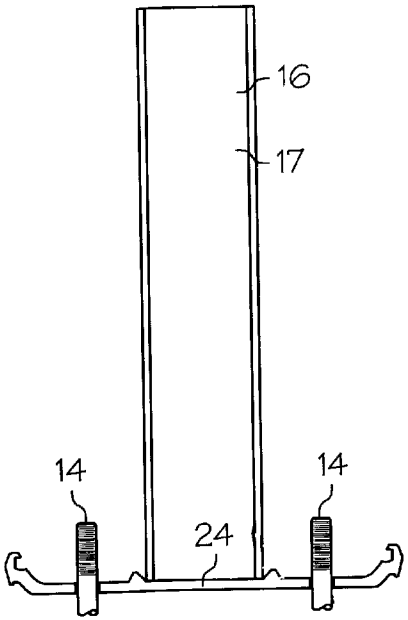
Figure 24:
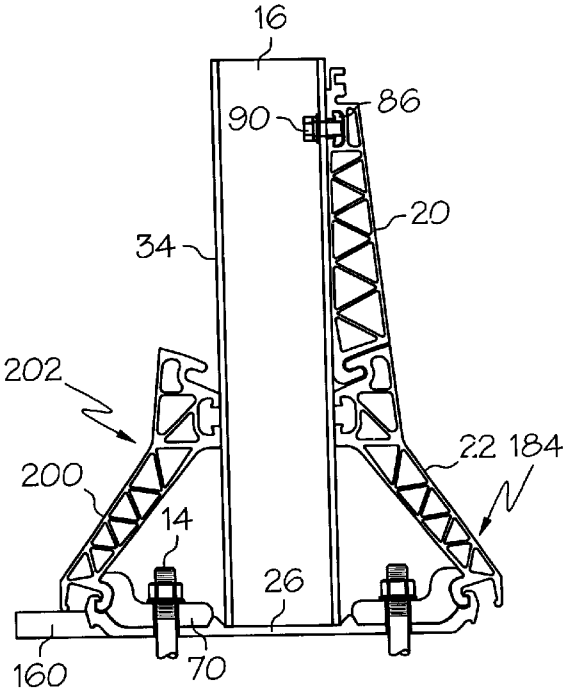

FIGS. 11–18 are a series of front views illustrating one manner for assembling the median barrier 10, and FIGS. 19–26 are a series of end views roughly corresponding to FIGS. 11–18. That is, FIG. 19 is an end view that roughly corresponds to the side view of FIG. 11; FIG. 20 is an end view that roughly corresponds to the side view of FIG. 12, and so on. As shown in FIG. 11, a series of mounting bolts 14 are first sunk into the deck 12, and the mounting bolts 14 are preferably coupled to or sunk into the deck 12 during the pouring or formation of the deck. The mounting bolts 14 are spaced longitudinally along the length of the deck 12, and generally define the location about which the median barrier 10 will be mounted. A series of posts/base plate combinations 17 are then located on the deck 12 by lowering each base plate 26 over a bolt 14 or set of bolts 14 such that each bolt(s) is received through a slot 48 in the base plate 26 (See FIGS. 7A, 7B). A plurality of support elements 52, 54 are then located on the deck 12 between each post 16, as shown in FIG. 11. The support elements 52, 54 are coupled to the deck 12 by lowering each support element 52, 54 onto the deck such that a bolt 14 is received through each elongated slot 62 of the support elements 52, 54 (See FIGS. 6A, 6B). FIG. 11 illustrates two sets of support elements 52, 54 located between each post 16, although this number may be varied, as desired. Once the posts 16, base plates 26 and support elements 52, 54 are located on the deck 12, they should form a generally straight line upon which the panels 20, 22 will be located, although the system can accommodate some curvature in the median barrier 10.

Figure 12:
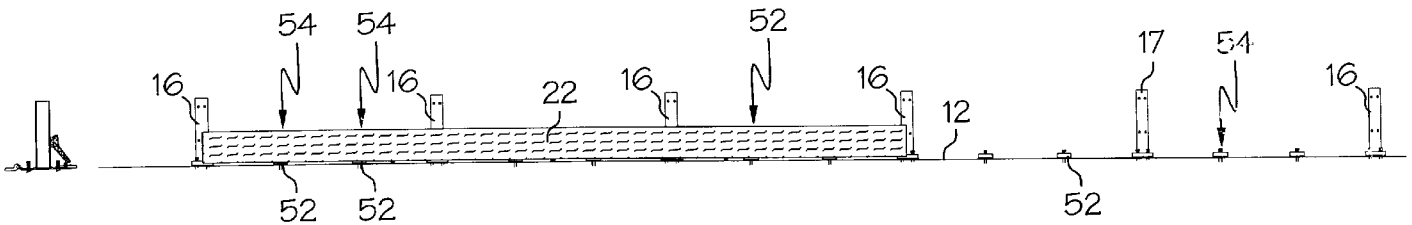
Figure 13:
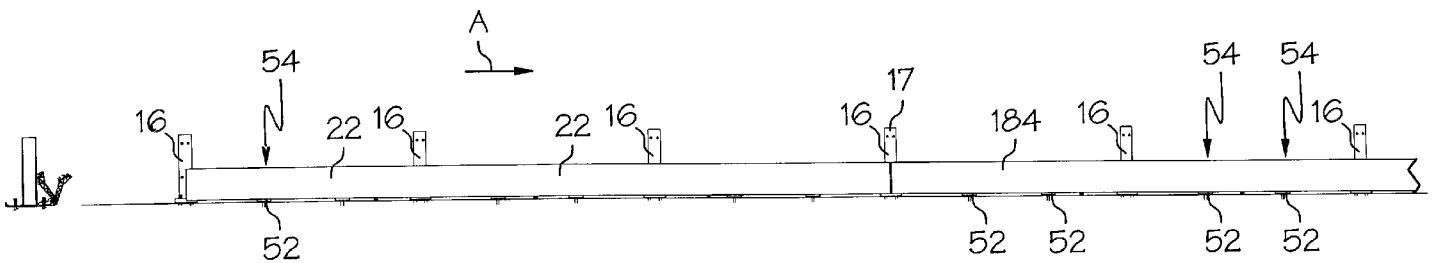

Next, as shown in FIGS. 12 and 20, a lower panel 22 is placed on a number of base plates 26 (four base plates 26 in the illustrated embodiment) and on the corresponding support elements 52 located between the base plates 26. The lower panel 22 is placed over the base plates 26 and support elements 52 such that the lower flange 23 of the lower panel 22 is received in the notches 46 of the base plate 26 and the notches 60 of the support elements 52. The panel 22 is then leaned against the posts 16, as shown in FIG. 20. A number of wooden blocks 160 may be located on the deck 12 below the lower panel 22 to help support the weight of the lower panel 22 and maintain the panel 22 leaned against the posts 16. Next, a toe clip 70 is located over each of the mounting bolts 14 that extend through the base plates 26 and support elements 52 that are receiving and supporting the lower panel 22.

As shown in FIG. 3, each toe clip 70 is mounted on a base plate 26 or support element 52 such that its open end 74 receives the lower flange 23 of the lower panel 22 therein. Alternately, in order to save time, the toe clips 70 may be mounted on only a few of the mounting bolts 14 extending through the base plates 26 and support elements 52 supporting the lower panel 22 to temporarily hold the lower panel 22 in place. Of course, in this case, the installer must return to later mount toe clips 70 over the remaining mounting bolts 14 before assembly is completed.

A nut 72 and washer 73 (FIGS. 4–5) are then loosely threaded onto each mounting bolt 14 protruding through a toe clip 70. The nuts 72 are not yet tightened down to allow for subsequent adjustments in the position of the base plates 26 and support elements 52 as the median barrier 10 is assembled. In particular, the elongated slots 48, 62 in the base plates 26 and support elements 52 allow the base plates 26 and support elements 52 to shift in the direction of the slots 48, 62. After the median barrier system is constructed and the pieces of the median barrier system, including the panels 20, 22, are fit together, the panels 20, 22 form a least-fit distance curve along the outer face of the panels. Thus, upon initial placement on the deck 12, the base plates 26 and support elements 52, 54 are only loosely bolted into place. As the upper 20 and lower 22 panels are subsequently mounted to the posts 16, the base plates 26 and support elements 52, 54 will adjust their lateral position via the slots 48, 62 to accommodate the grade and curve of the deck. The slots 48, 62 also provide compensation for bent panels as well as misaligned posts.

Once the desired toe clips 70 are mounted into place, the lower panel 22 is essentially captured between the toe clips 70 and the ridges 44, 58 of the base plates 26 and support elements 52. The lower panel 22 can pivot about its lower flange 23, but the lower panel cannot be lifted vertically out of place. Once the lower panel 22 is captured by the toe clips 70, the only way to remove the lower panel is to longitudinally slide the lower panel out of the clips 70, or to remove the toe clips 70 to enable the lower panel 22 to be lifted vertically.

The engagement of the lower panel 22 by the toe clips 70 and base plate 26 and support elements 52 enable the rotation of the lower panel 22. Referring to FIGS. 3–5, each lower panel 22 includes a lower flange 23 that includes a generally outwardly extending lip 25. Each toe clip 70 includes an open end 74 that receives the lower flange 23 of the lower panel 22 therein, such that the lower flange 23 is captured between the open end 74 of the toe clip 70 and the ridge 44 on the base plate 26, or captured between the open end 74 of a toe clip 70 and a ridge 58 of a support element 52. The open end 74 of the toe clip 70 is generally curved, or concave, and contoured to match the profile of the outer surface of the lower flange 23. The lip 25 of the lower flange 23 is received in a notch 46 formed in the ridge 44 of the base plate 26 (FIG. 4), or received in a notch 60 of the ridge 58 of support element 52.

The curved inner edge of the open end 74 of the toe clip 70 has a common center rotation with the curved outer surface of the flange 23 of the lower panel 22, and the common centers of rotation enables free rotation of the panel 22 within the toe clip 70 and base plate 26. In this manner, the lower panel 22 may be rotated to its open position 22' shown in FIG. 22, such that the upper panel 22' stably rests on the deck 12 or against the base plate 26. When the panel 22 is in the open position, the lower panel 22 is supported by its heel 182 resting on the deck 12 or engaging the base plate 26.

Once the lower panel 22 is properly located and all of the desired toe clips 70 are in place, the spacer blocks 160 are knocked out from under the lower panel and the nuts 72 on the mounting bolts may be tightened down. In order to access the nuts 72 on the mounting bolts 14, the lower panel 22 is preferably rotated to its open position, shown as panel 22' in FIG. 21. In this position, the lower panel 22' is rotated out of the vertical plane of the mounting bolts 14 which allows a worker to easily access the mounting bolts 14 and tighten the nuts 72 down. After the nuts 72 are tightened down, the lower panel 22 is preferably left in its open position for the time being.

After the toe clips 70 are tightened down, a second lower panel 184 (FIG. 13) is then installed adjacent the first lower panel 22 in the downstream direction (the direction indicated by arrow A in FIG. 13) by lowering the panel 184 over a plurality of base plates 26 and support elements 52 located on the deck, in the same manner as panel 22 described above. A slight gap (i.e., about one-quarter to about one-half inch) is preferably maintained between the first lower panel 22 and the second lower panel 184, and the lower panels 22, 184 are preferably located such that the gap is formed at a post 16, such as post 16' in FIG. 13.

A set of toe clips 70 are then mounted on the base plates 26 and support elements 52 that receive the second lower panel 184 to capture the second lower panel 184 between the toe clips 70 and support elements/base plates. The second lower panel 184 may be pivoted to its open position in the same manner described above for the first lower panel 22 to provide access to the bolts 14 for securing the nuts 72. A set of nuts 72 are then located on top of the mounting bolts 14 extending through the newly-located toe clips 70, and tightened down to fasten the second lower panel 184, and associated posts 16, toe clips 70, base plates 26 and support elements 52 to the deck 12. The second lower panel 184 is preferably left in its open position for the time being.

Figure 14:
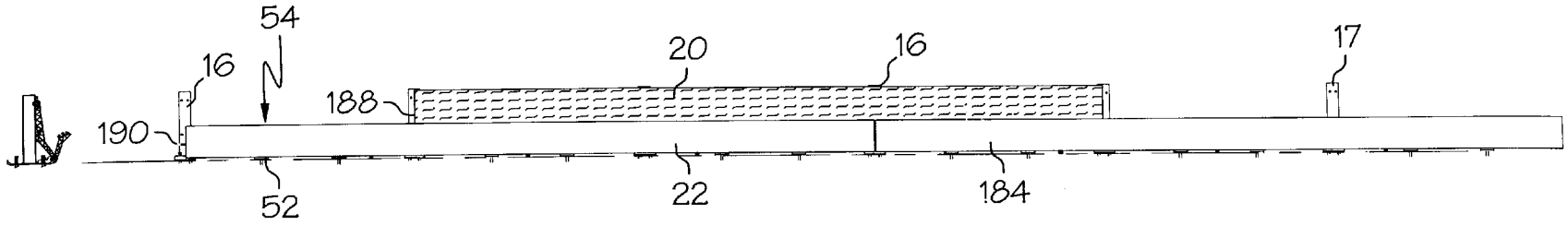
Figure 15:
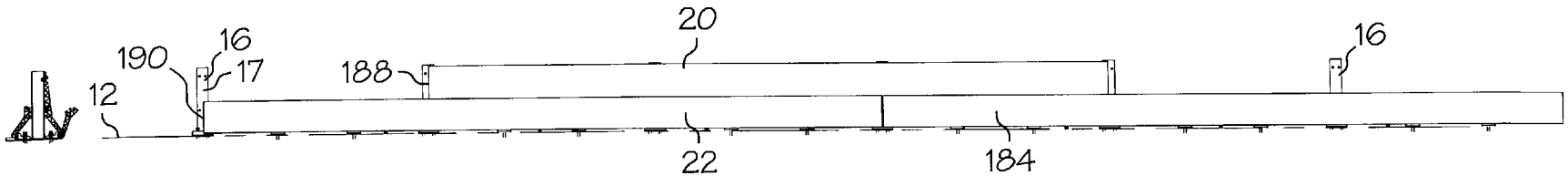
Figure 16:
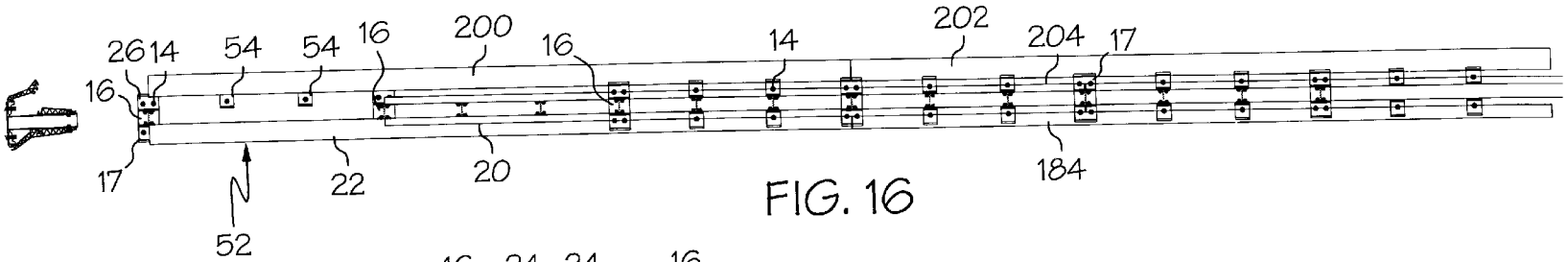

After the two lower panels 22, 184 are secured, an upper panel 20 is secured to the posts 16 as shown in FIG. 14.

In order to couple the upper panel 20 to the posts 16, the upper panel is located such that its channel 80 is located adjacent to the upper holes 36 of the flanges 32 of the posts 16. Next, a set of clamp bars 86 (i.e., ten clamp bars) are slid into the channel 80 in the upper panel 20. The clamp bars 86 are moved longitudinally down the panel 20 until the holes 92 in each clamp bar 86 are aligned with a set of upper holes 36 in an associated post 16 (i.e., see FIG. 11). As will be clear for reasons discussed below, two clamp bars 86 are preferably located between each clamp bar 86 that will be coupled to a post 16 (these clamp bars will be used to couple the upper panel 20 to the backing posts 16). A set of fasteners 90 are then passed through the upper holes 36 in each of the four posts 16 spanned by the upper panel 20 and threadedly received in an associated clamp bar 86 received in the channel 80 of the upper panel 20 to attach the upper panel 70 to the posts 16. The upstream edge 188 of the upper panel 20 is preferably offset from the upstream edge 190 of the first lower panel 22 by, for example, one post 16. The offset helps to avoid concentrating any discontinuities in the median barrier 10 at a common vertical location, which improves the continuity of the system. In other words, the gap between the adjacent lower panels 22, 184 at post 16' is spanned by the upper panel 20 located immediately above the gap, much in the same way bricks are commonly spaced in masonry work.

As will be described in greater detail below, the clamp bars are fixed to the posts 16, but the panel 20 can move relative to the clamp bars 86 and posts 16 due to the fact that the clamp bars 86 are slidably received in the channel 80. Preferably, a clamp bar 86 is located at each post 16 spanned by the upper panel 20. When a post 16 is located adjacent the end of a panel 20 (such as upstream end 188 of upper panel 20), only a single fastener 90 may be passed through the post 16 and into a clamp bar 86.

Figure 23:
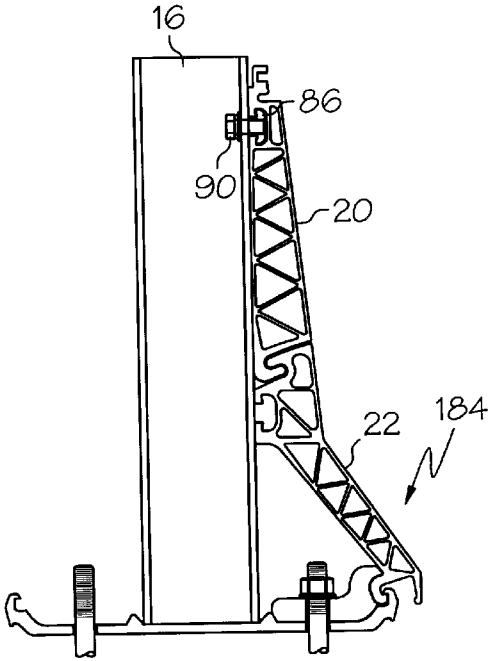
Figure 22:
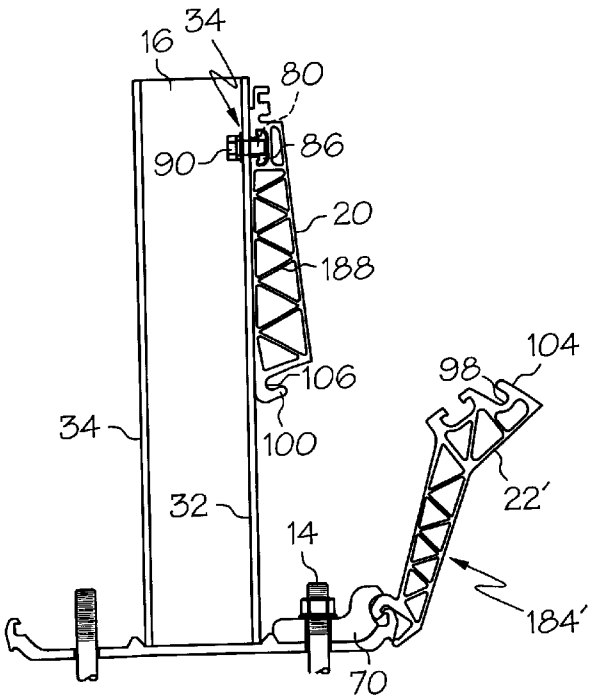
Figure 26:
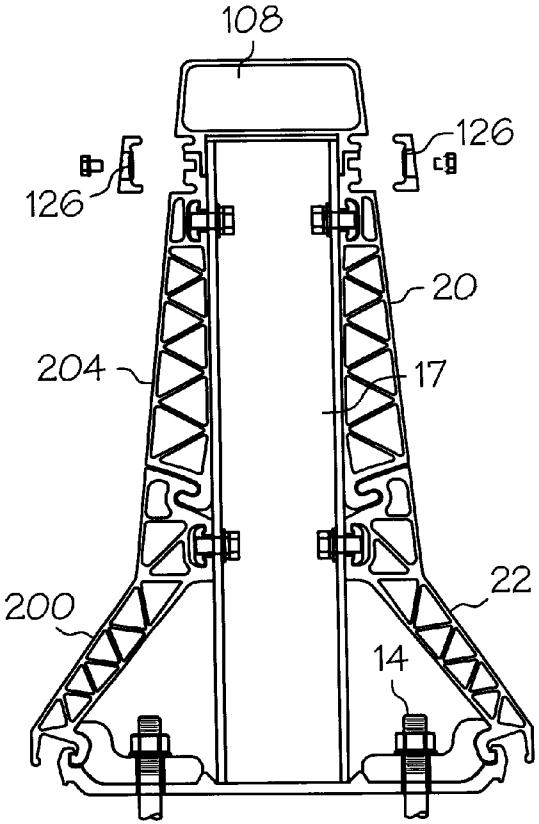

Once the upper panel 20 is attached to the posts 16, the lower panels 22, 184 are pivoted from their open positions (shown as lower panels 22' and 184' in FIG. 22) into their closed positions (shown as lower panels 22, 184 in FIG. 23). The tab 100 in the upper panel 20 is received in the groove 98 in the lower panels 22, 184 and the tabs 104 of the lower panels are received in the groove 106 of the upper panel 20 to lock the upper 20 and lower panels 22, 184 together.

Figure 25:
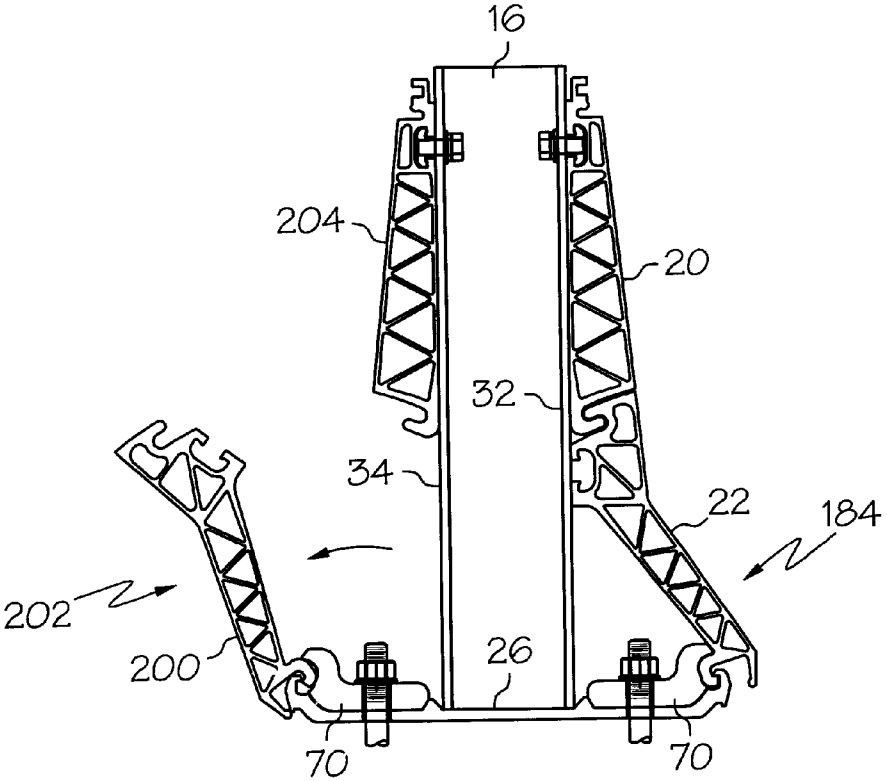

Once the two lower panels 22, 184 and an upper panel 20 are mounted on one side of the posts 16, the same process is repeated on the opposite side of the posts 16. Thus, two adjacent lower panels 200, 202 (FIG. 16) are mounted to the base plates 26 and support elements 54 on the opposite side of the post 16, and a series of toe clips 70 are located on the mounting bolts 14 in the same manner as described above (see FIG. 24). The lower panels 200, 202 are then pivoted to their open position, as shown in FIG. 25. A set of clamp bars 86 are then slid into the upper panel 204, and the upper panel is lifted into place such that its channel 80 is located adjacent to the upper holes 36 in flanges 34. The clamp bars 86 are then slid down the panel 204 until aligned with a set of upper holes 36 in flange 34 of post 16, and then coupled to the post 16 with fasteners 90, which couples the upper panel 204 to the posts 16. The lower panels 200, 202 are then pivoted to their closed position such that they engage the upper panel 204. After the lower panels 22, 184, 200, 202 and upper panels 20, 204 are installed on either side of the posts 16, alternating lower and upper panels may then be installed on either side of the posts 16 down the length of the deck 12.

Once sufficient upper and lower panels have been installed downstream, the lower panels 22, 184, 200, 202 must be coupled to the posts 16. This is accomplished by sliding clamp bars 60 into the channel 82 of each lower panel 22, 184, 200, 202 until the holes 92 in each clamp bar 86 are aligned with the corresponding set of lower holes 24 in each post 16. Any clamp bars 86 that may be needed to couple the lower panels to the backing panels 66 are also preferably slid into the channels 82 at this time. A set of fasteners 90 are then passed through the lower holes 76 in the posts 16 in both flanges 32, 34 and received in the holes 92 of clamp bars 86 and tightened down.

A torque wrench is preferably used to tighten down the fasteners 90 into the clamp bars 86, as the tightening of the fasteners 90 by the torque wrench pulls the lower panels 22, 184, 200, 202 into full engagement with the associated upper panels 20, 204 to ensure the tab 100 of the upper panels is fully received in the groove 98 of the lower panels, and that the tab 104 of the lower panels is fully received in the grooves 106 of the upper panels. The force of the torque wrench should overcome any interference between the tabs 100, 104 and the associated grooves 98, 106 to ensure a tight fit. The clamp bars 86 are preferably mounted at each post 16 for all of the lower panels on both sides of the posts 16, except for the last downstream lower panel.

Next, a series of backing posts 66 (FIG. 5) are mounted to the back of the lower 22, 184, 200, 202 and upper 20, 204 panels above each of the support elements 52, 54 to complete the intermediate bases 24 and provide further stiffening to the median barrier 10. The backing posts 66 also help to ensure that the upper panels 20, 204 remain coupled to the lower panels 22, 184, 200, 202 when transverse forces are applied to the median barrier system 10. As shown in FIG. 5, the backing posts 66 are coupled to the upper and lower panels by clamp bars 86 received in the grooves 80, 82 of the upper 20 and lower 22 panels, and fasteners 90 are received in the holes 92 of the clamp bars in a manner analogous to the coupling of a post 16 to the panels as described above. Preferably, the lower panels on one side of the posts 16 are left in their open position while the fasteners 90 of the clamp bars 86 for the lower panels on the other side of the posts are tightened down. Then, after the lower panels 22 on one side of the posts 16 are coupled to the posts 16 and backing posts, the lower panels 22 on the other side of the posts 16 are rotated to their closed position and coupled to the posts 16 and backing posts 66.

After the upper 20, 204 and lower 22, 184, 200, 202 panels are secured to the posts 16 and the backing posts 66, the top cap 108 is installed onto the upper panels 20, 204. As shown in FIG. 18, the upstream edge 109 of the top cap 108 is preferably longitudinally offset in the downstream direction by one post 16 from the upstream edge 188 of the upper panel 20. This arrangement of the top cap 108 ensures that any gaps between the top caps 108 are offset from any gaps between the upper panels and/or gaps between the lower panels. After the top cap 108 is placed on top of the upper panels, the side rails 126 (FIGS. 3–5) are fit into the groove 136 in the upper panels and a groove 120 in the top cap 108, and the fasteners 138 are threaded into the running thread 140 to secure the top cap 108 to the upper panel 20.

The side rails 126 couple the top cap 108 to the upper panels, and the side rails 126 may be pulled into a state of tension by the upper panels and top cap 108. That is, as shown in FIG. 5, each side rail 126 includes an upper flange 130 and a lower flange 132 that are received in the groove 120 in the top cap 108 and the groove 136 in the upper panel 20. The grooves 120, 136 may have a vertical spacing that is slightly greater than the vertical spacing between the flanges 130, 132, to pull the side rails 126 into tension when they are mounted to the median barrier. Once installed, the side rails 126 also helps to transmit vertical loads between the upper panel 20 and the top cap 108.

Figure 27:
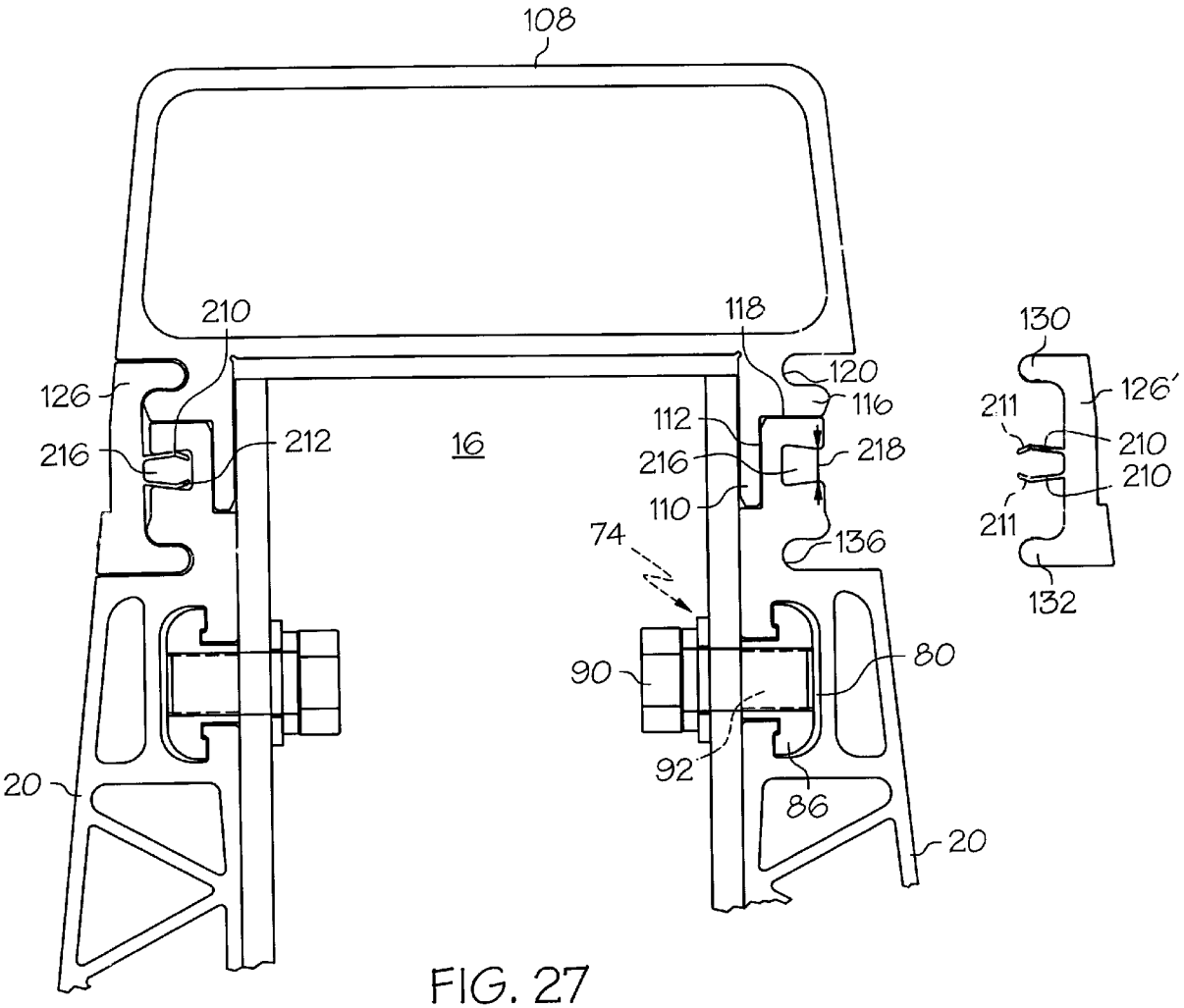
FIG. 27 is a partially exploded detail end cross section of the median barrier of the present invention illustrating an alternate side rail.

An alternate embodiment of the side rail 126' is shown in FIG. 27. The alternate side rail 126' includes a pair of opposed, outwardly extending barb portions 210, 212. The barb portions 210, 212 are shaped to be received in a channel 216 in the upper panel 20. The barb portions 210, 212 each include an inwardly-tapered end 211. The barb portions 210, 212 are curved and spaced apart a distance slightly greater than the entry height 218 of the channel 216. Thus, when the side rail 126' is urged against the channel 216, the barb portions 210, 212 are compressed towards each other to fit into the channel 216. Once received in the channel 216, the barb portions 210, 212 extend outwardly against the walls of the channel 216 to retain the side rail 126' in position.

The side rail 126' may be installed by urging the barb portions 210, 212 into the channel 216 by using a clamp at one end of the upper panel 20 to force the barb portions 210, 212 into the channel 216. Once the side rail 126' is "started" in the channel 216, a worker may use a sledge hammer or other tool to knock the remaining length of the side rail 126' into place, using a block of wood or other material to protect the outer face of the median barrier 10. The alternate side rail 126' eliminates the use of any fasteners on the outer surface of the side rail 126'.

When the median barrier 10 is damaged or deformed due to vehicle crashes or other deforming forces, the median barrier can be easily removed from the deck 12. In order to remove median barrier 10, the side rails 126 are first removed and the top caps 108 are lifted out of place. The fasteners 90 that couple the clamp bars 86 to the upper panels 20 and lower panels 22 can then be unscrewed, and the lower panels 22 can be pivoted to their open positions. The upper panels 20 can then be lifted out of place. Preferably, the fasteners 90 located on only one side of the median barrier are first loosened. After the clamp bars 86 attaching the lower panels 22 on one side of the median barrier are removed, those lower panels 22 may be pivoted to their open positions to provide easier access to the fasteners 90 on the other side of the median barrier.

The fasteners 64 on the remaining lower panels 22 are then removed. Finally, the remaining lower panels 22 may be pivoted to their open positions to provide access to the mounting bolts 14. The nuts 72 on all the mounting bolts 14 may then be loosened such that the toe clips 70, lower panels 22, posts 16 and base plates 26 may be lifted out of place. This method of removal provides a significant advantage over many prior art systems that may include interlocking extruded profiles. In such prior art systems, the only way in which the upper or lower panels can be uncoupled is to laterally slide the upper panel out of the lower panels. However, when the panels of the prior art median barrier systems are deformed, such as after a collision, the panels cannot slide relative each other. In this case, entire sections of the median barrier must be saw-cut to remove the median barrier.

Another advantage provided by the median barrier of the present invention is that the outer face 220 (FIG. 3) of the median barrier 10 is generally continuous. Because, unlike many prior art systems, the median barrier 10 does not have holes in its outer face 220 to provide access to any bolts for attaching the panels, the generally continuous outer surface 220 provides greater load transferring characteristics and improves the median barrier's appearance. Furthermore, as noted earlier, the median barrier does not have any vertical discontinuities that extend through the height of the system, which increases its strength. For example, if a load (i.e. by a vehicle wheel) is applied at the gap between a pair of upper panels 20, the upper panels 20 retain their longitudinal bending strength and tensile capability to transfer the load to the adjacent upper panels 20, lower panels 22, and other adjacent load-bearing components.

Figure 8:
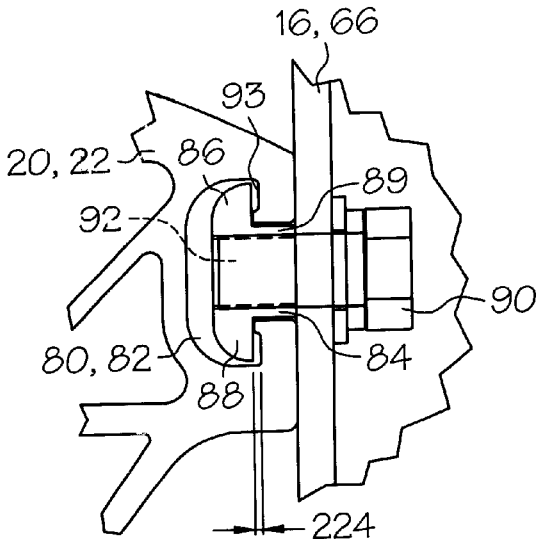
FIG. 8 is a detail end cross section of a portion of a side panel receiving a clamp bar therein.

As shown in FIG. 8, each clamp bar 86 that attaches a panel 20, 22 to a post 16 or backing post 66 includes a stem portion 89 and a head portion 88. When locked into position, the stem portion 89 extends through the throat 84 of the channels 80, 82, is received in the post 16 or backing post 66. The clamp bar 86 is preferably designed (such as by controlling the length of the stem portion 89) such that a gap 224 is maintained between the head portion 88 and the inner wall 93 of the channel 80, 82 formed in the panels 20, 22. In one embodiment, the gap 224 is about 0.015 inches. This gap 224 reduces or eliminates the frictional interference between the clamp bar 86 and the panel 20, 22, and thereby allows the panels 20, 22 to move laterally relative the clamp bars 86 and posts 16 or backing posts 66. Thus, the clamp bars 86 provide vertical restraint, but allow the panels 20, 22 to move longitudinally or horizontally to accommodate thermal expansion or contraction, although movement in the horizontal direction may be restrained by friction forces between the clamp bars 86 and the walls of the channels 80, 82, or any additional friction forces.

During installation, a small gap (i.e. about ⅛" to ¼") is also preferably left between adjacent components such as adjacent lower panels 22, upper panels 20, top caps 108, etc., to accommodate thermal expansion and contraction. The median barrier 10 may also include a series of regularly spaced clamps or other attachment means along the length of the median barrier that rigidly attach a panel or panels 20, 22 to a pair of posts 16. These clamps may be included to limit the longitudinal migration of the panels 20, 22. In some cases, clamp bars having a shorter shank, or stem portion 89, than that disclosed above may be used such that the clamp bar 86 grips the associated panel 20, 22 and prevent longitudinal movement of the panel 20, 22 for this or other purposes.

In many prior art systems, the posts 16 served primarily to resist rotation of the barrier by supplying a reaction force through the bending stress of the posts. However, accommodating applied loads by bending forces is relatively inefficient. The median barrier 10 of the present invention converts the applied loads primarily into tensile and compressive forces, which can be accommodated more effectively.

Figure 52:
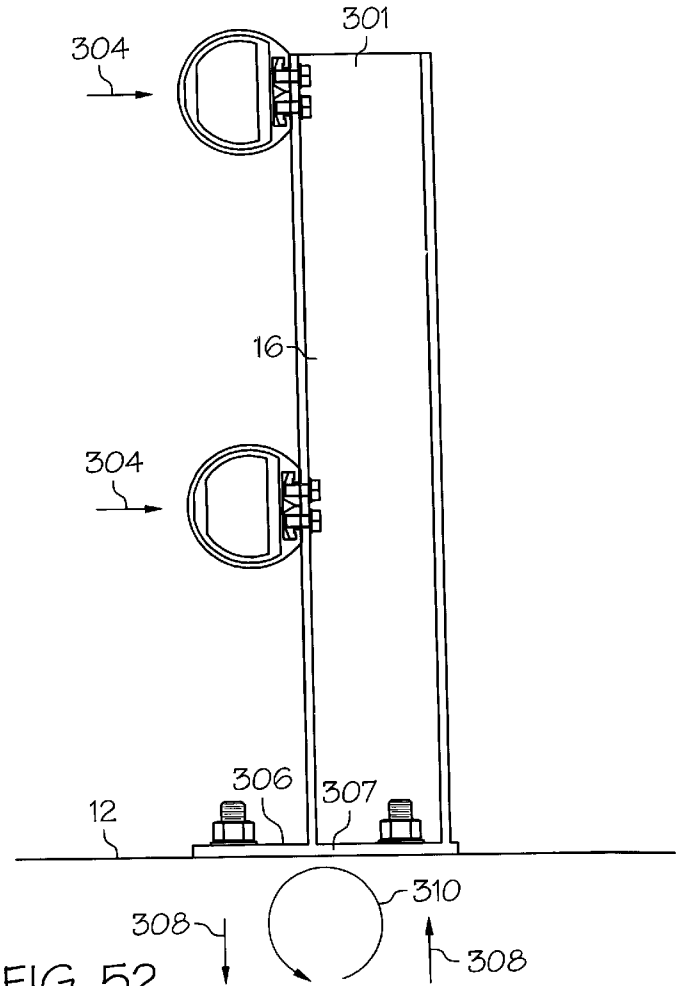
FIG. 52 is an end view of a conventional guard rail, illustrating the guard rail's reaction to applied forces.

For example, FIG. 52 illustrates a conventional rail system 301 including a post 16, a pair of load bearing components 304 bolted to the post 16, and a base plate 305 welded to the post 16, with the base plate 305 being bolted to the deck 12. When external forces 304 are applied to the rail system 301, the central web 30 and end flanges 32, 34 of the post 16 are primarily placed in a state of tension. A large moment force is generated at the point of attachment 307 between the post 16 and the base plate 305, which therefore requires a strong attachment between the post 16 and base plate 306. Relatively large reaction forces 308 and a relatively large bending moment 310 are created.

Figure 50:
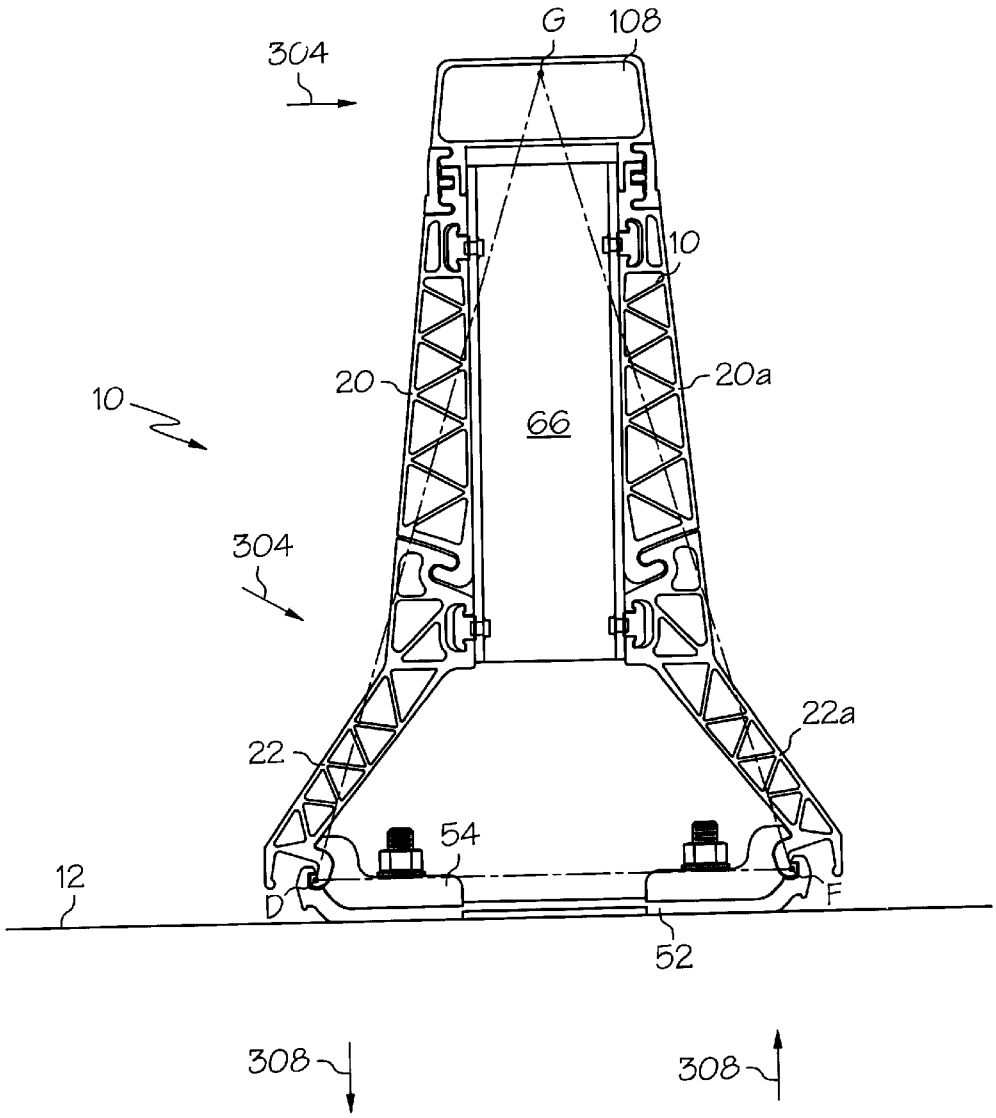
FIG. 50 is an end view of the median barrier of the present invention, illustrating the median barrier's reaction to applied forces.

In contrast, the median barrier 10 of the present invention is shown in FIG. 50. When external forces 304 are applied to the median barrier 10 of the present invention, the upper panel 20 and lower panel 22 on the right hand side of the post 16 (i.e. panels 20*a* and 22*a* in FIG. 50) are placed into a state of compression, and accommodate most of the applied forces 304. Thus, the reaction forces 308 of the median barrier 10 are relatively low compared to those of the rail system of FIG. 52, and the bending moment 310 created in the system of FIG. 52 is virtually eliminated. Furthermore, the median barrier of FIG. 50 opposes the applied forces 304 primarily by placing the panels 20*a* and 22*a* into compression, which is a much more effective manner of accommodate forces than the creation of tension in the rail system 301 of FIG. 52.

Thus, the "triangular" shape created by the support elements 52, 54, the two opposed lower panels 22 and the two opposed upper panels 20 (as well as the top cap 108 to a degree) form a basic load-bearing unit of the median barrier 10 as illustrated by triangle DGF of FIG. 50. The median barrier 10 of FIG. 50 can be modeled by visualizing 3 bars that are pinned together at their ends to form the triangle DGF. Thus, when a load 304 is applied to the "bar" defined by line DG, the "bar" defined by line GF in placed into tension. The bar defined by line DG is primarily comprised of panels 20, 22, and the bar defined by line GF is primarily comprised of panels 20*a*, 22*a*. In this manner, the median barrier 10 forms a triangular truss.

Figure 28:
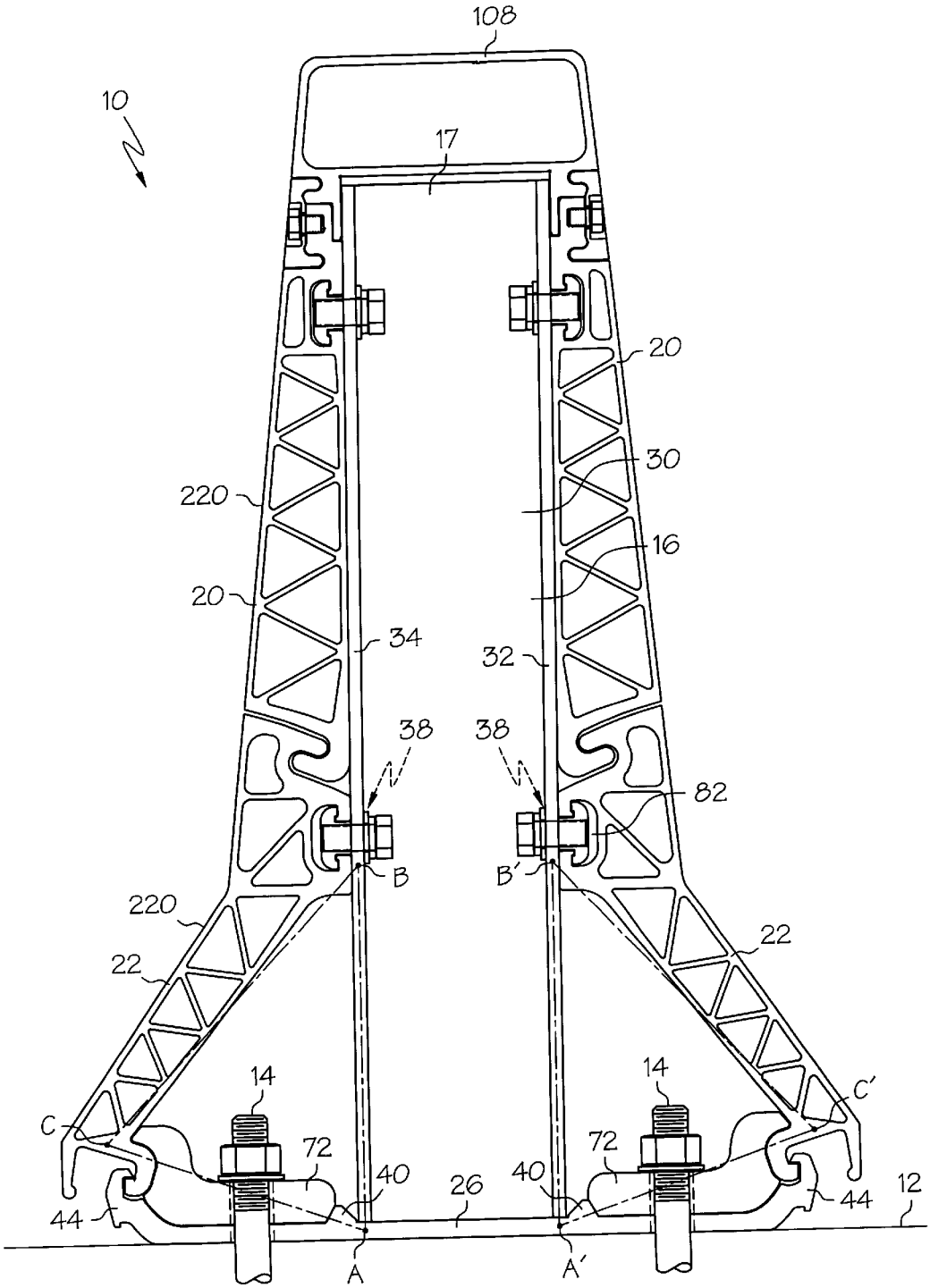
FIG. 28 is an end cross section of the median barrier of FIG. 3 illustrating a load-bearing characteristic of the median barrier.
Figure 29:
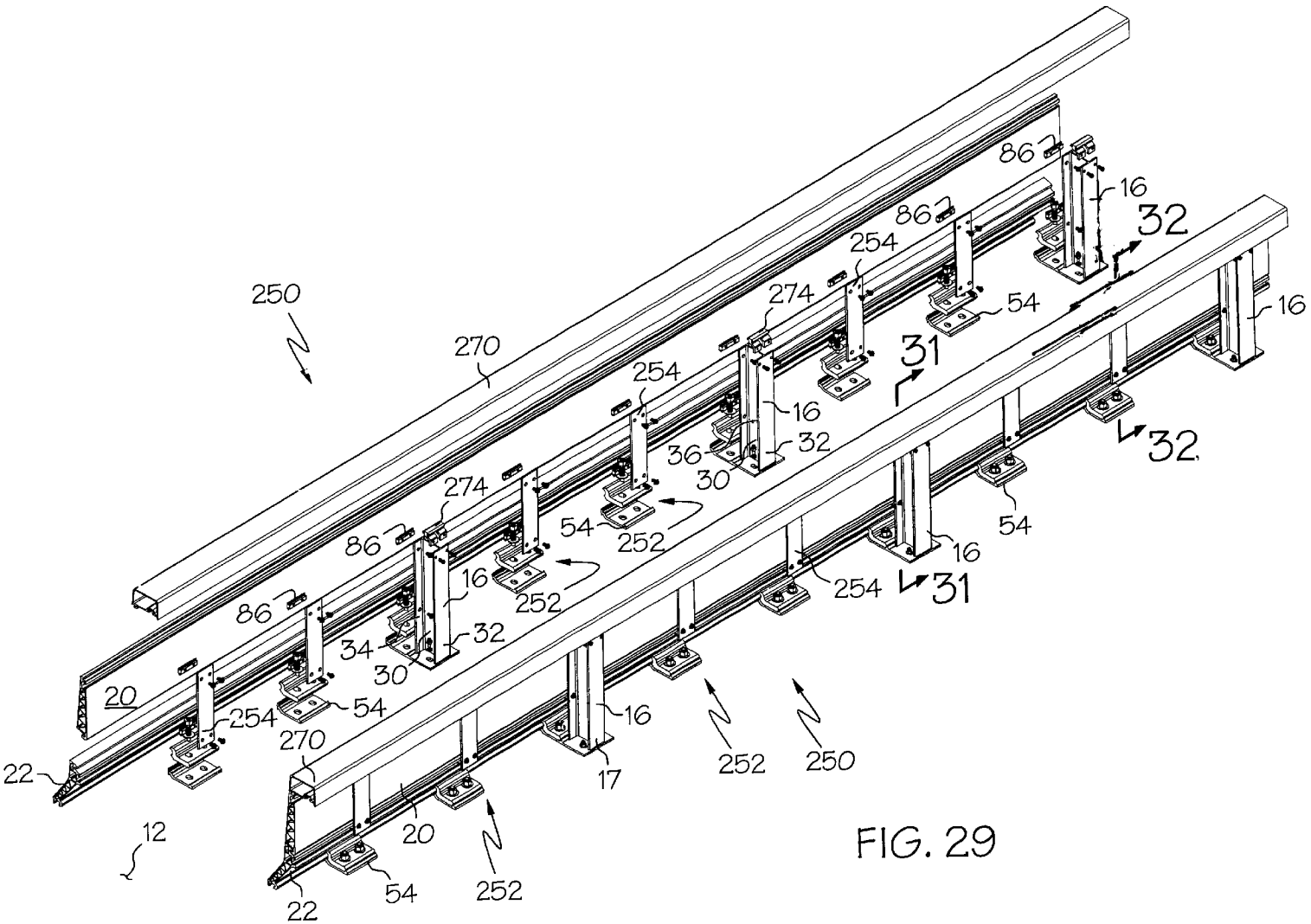
FIG. 29 is a partially exploded perspective view illustrating a preferred embodiment of the parapet of the present invention.
Figure 30:
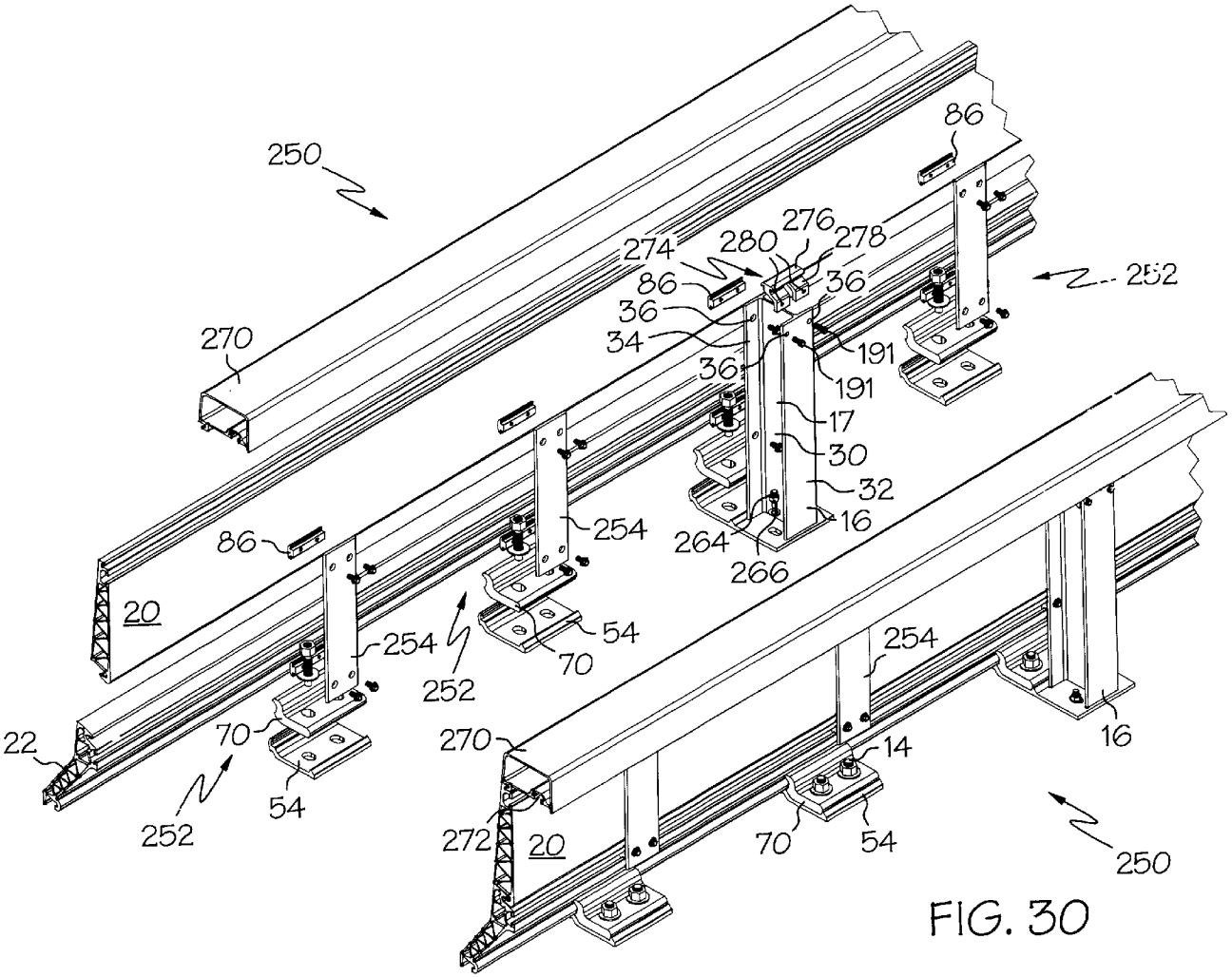
FIG. 30 is a detail view of the parapet of FIG. 29.

As shown in FIG. 28, a triangular force truss ABC is present at each location of a post 16. In this case, the base plate 26 interacts with the lower panel 22 and end flange 34 of the post 16 to define a triangle ABC which acts as a triangular truss which significantly reduces or eliminates bending at the junction of the post 16 and the base plate 26. Triangle ABC also converts applied forces into compression forces, similar to the triangle DGF discussed above. With the base plate 26 bolted to the deck 12, when loads are applied to the outer face 220 of the median barrier 10, the forces are generally converted into compression forces in the post 16 and/or tension forces in the lower panel 22. The triangle ABC thereby converts bending stresses generally into tensile and compressive loads in the face 220 of the panels 22, in the flanges 32, 34 or web 30 of the post 16, and in base plate 26. Triangle A'B'C', which is present on the opposite side of the post 16, can similarly accommodate loads applied to that side of the median barrier 10, and may also contribute to accommodating loads primarily accommodated by force triangle ABC.

Because bending stresses applied to the posts 16 are nearly eliminated, the thickness of the posts and/or the weldment of the posts 16 to their associated base plates can be reduced. This, in turn, results in a cost savings in the posts. More lightweight materials, such as aluminum, may be used, and the amount of material used at the weldment points can also be reduced.

When forces are applied at a longitudinal location of the median barrier where a post 16 is located (i.e. FIG. 28), the triangles ABC, A'B'C' covert most of the applied forces into tension and compression forces in the post 16. Although the force triangle DGF of FIG. 50 is still present at a post location, the force triangle ABC of FIG. 28 accommodates most of the applied forces at a post 16. When forces are applied at a location other than at a post (i.e. FIG. 50), the force triangle DGF accommodates most of the applied forces.

The two opposed lower panels 22 can be directly or indirectly coupled together. When coupled directly together, the lower panels 22 are simply bolted or otherwise coupled directly together (not shown in the drawings). When indirectly coupled, both the opposed lower panels 22 can be coupled to either a post 16 or a backing post 66 (i.e. see FIG.

50), either of which may be termed a "spacer". When not coupled to a post 16 or backing post 66 at any longitudinal location along the median barrier 10, the two opposed lower panels 22 are indirectly coupled by the associated, adjacent upper panels 20 and the top cap 108. Thus, triangular truss system DGF of the median barrier of FIG. 50 is present even when a post 16 or backing post 66 are not present at any specific longitudinal location.

As noted earlier, the projections 40 in the base plates 26 helps to define the location of the toe clips 70 and therefore the position of the lower panels 22 relative to the base plate 26. In other words, the lateral separation of the lower panels 22 can be controlled without imposing any alignment stresses on the panels. Furthermore, the location of the lower holes 38 in the posts and various other dimensions of the median barrier 10 can be selected by the designer. In this manner, the dimensions of the triangles ABC and DGF may be controlled. Thus, because the dimensions of the truss triangles ABC and DGF can be tightly controlled, the tolerances in the system, such as the length of the slots 62, 48 in the support elements 52, 54 and base plates 26, or the size of the holes in the toe clips 70 that receive the mounting bolts 14, or other tolerances, may be reduced. The resulting tighter-toleranced system helps to maintain the shape of the triangles ABC and DGF, even when deforming forces are applied to the system. This ensures the triangles ABC and DGF generally maintains their shape and acts as a load-receiving trusses, and improves the load-handling characteristics of the system.

For example, in many prior art safety shape barriers or parapets, a foot piece is coupled to the deck, the foot piece having a slot therein. In order to assemble the safety structure, a panel is then slid into the foot piece. The panel typically includes a downwardly-extending flange that is received in the slot of the foot piece. The panel is then rigidly bolted to a post by passing a bolt through aligned holes in the panel and post.

However, in such a system the flange of the panel is typically loosely received in the slot of the foot piece. This provides some "give" or tolerance in this system that enables the hole in the panel to be aligned with the hole in the post to receive the bolt therethrough, or to allow the panel to be tightly pulled up against the post. However, this "give" in the system causes the system to inefficiently handle applied loads. For example, when a load is applied to the panels of such a system, the panel is shifted towards the post until the "give" or tolerance at the lower end of the panel is taken up. However, because the panel and post are bolted together, this movement of the panel is transmitted to the post, which causes the post to bend. Transmitting the applied loads into bending forces in the posts in this manner is an inefficient method for taking up applied loads.

Figure 55:
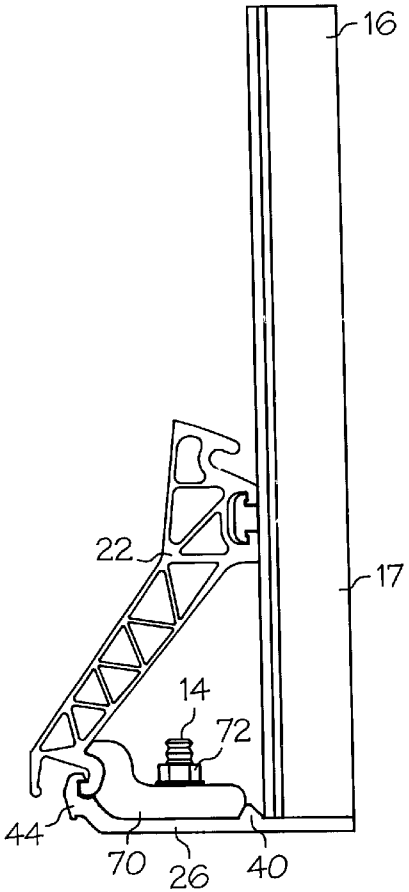
FIGS. 53–55 are a series of end cross section views illustrating a lower panel as it is pivoted from its open position to its closed position.
Figure 54:
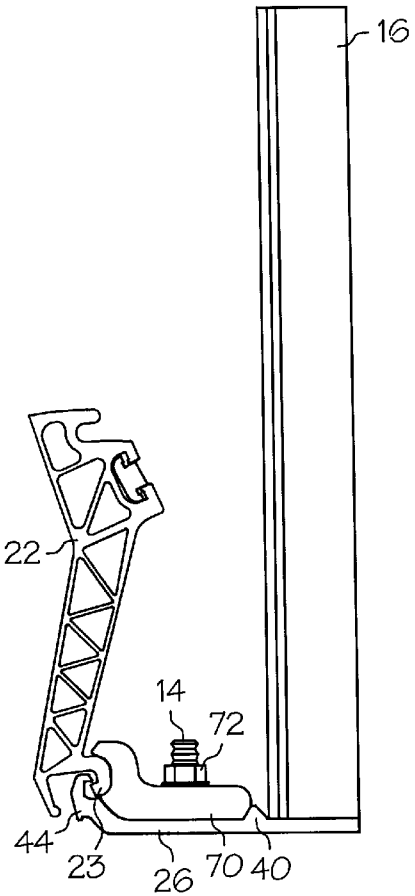
Figure 53:
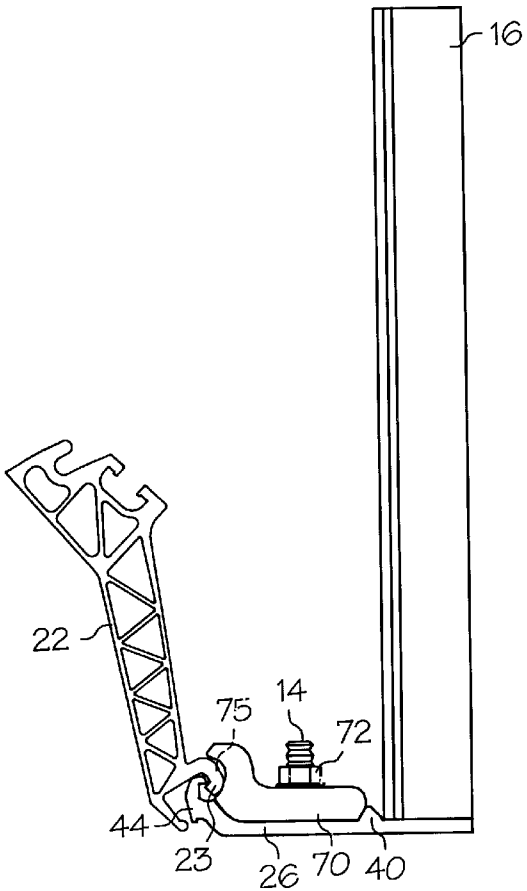

In contrast, in the present invention the toe clips 70 and base plates 26 of the present invention tightly capture the lower end of the lower panels 22 to ensure there is little to no "give" or tolerance in the system. For example, as shown in FIGS. 53–55, as a lower panel 22 is rotated from its open position (FIG. 53) to its closed position (FIG. 55), the flange 23 is forced into the opening 75 between the toe clip 70 and ridge 44 in a camming action. This ensures a tight fit between the flange 23, base plate 26 and toe clip 70. Furthermore, when the nut 72 over the toe clip 70 is tightened down, the toe clip 70 is pressed downwardly such that the toe clip 70 is pressed down flat against the base plate 26. That is, the toe clip 70 is pressed downwardly and "cammed" between the triangular projection 40 and the ridge 44.

Figure 51:
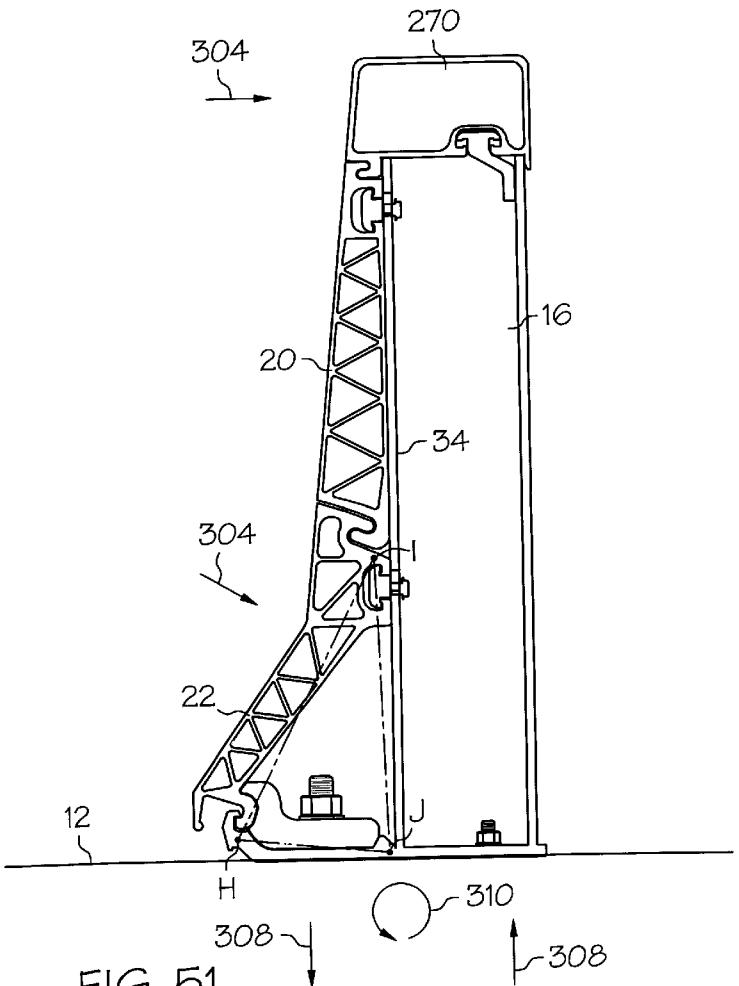
FIG. 51 is an end view of the parapet of the present invention, illustrating the parapet's reaction to applied forces.

Thus, by precisely locating the toe clip 70 on the base plate 26, the location of the opening 75 is precisely controlled. Furthermore, the ridges 44 precisely locate the lower end of the lower panel 22 such that the lower end of the lower panel 22 is tightly captured between the toe clip 72 and base plate 26. This system for assembling the median barrier 10 ensures that there are very tight tolerances in the links or legs AC or A'C' of triangles ABC or A'B'C' of FIG. 28. This, in turn, ensures that the applied forces are efficiently transferred into tension and compression forces, and little or no bending loads applied to the post 16. Similarly, the link or leg HJ of triangle HIJ in FIG. 51 is tightly toleranced.

Once the median barrier 10 is constructed, the posts 16 are fully surrounded by the closed system of the median barrier. Furthermore, when a load is applied to the median barrier 10, the median barrier accommodates the majority of the load. The panels 20, 22 on the side of the barrier to which the load is applied are typically placed into a state of tension by the applied load, and the panels 20, 22 on the opposite side of the barrier are placed into a state of compression. The loads that are applied to the posts 16 are principally compression loads to resist rotational movement of the barrier. The intermediate bases 24 and support elements 52, 54 also restrain the panels 20, 22 from lateral movement when forces are applied to the median barrier. Thus, in the present invention the posts 16 are not necessarily required as a load-bearing component, but primarily aid in the assembly of the median barrier 10, and provide a line-of-sight for the assembling workers. However, the posts 16 also act as a redundant structural support should the panels 20, 22 fail.

The posts 16 are preferably regularly longitudinally spaced across the road surface. However, various obstructions in the road surface may cause the posts to be spaced unevenly across the road surface and median barrier of the present invention can accommodate variations in the longitudinal locations of the posts. The longitudinal spacing of the posts 16 may be varied, although preferably there is a post 16 located at the end and beginning of each panel 20, 22. Thus, the spacing between each adjacent panels should be controlled by the installer so that improper alignment of the posts and panels do not accumulate. If the spacing between adjacent panels is not controlled, the cumulative effect can cause the end of downstream panels to not be aligned with a post.

If a post 16 cannot be located at the end or beginning of each lower panel 20, an intermediate base 24 is preferably placed at the end or beginning of such panel to restrain the lateral movement of the panels. The intermediate base 24, and more particularly the support elements 52, 54, preferably have a length sufficient to bridge the obstruction in the road. In other words, the intermediate base 24 preferably extends in the longitudinal direction a sufficient length to "pass over" or bridge the obstruction. The support elements 52, 54 may be several feet long, or longer, as needed to bridge the obstruction (although intermediate bases of this length are not specifically illustrated herein). Of course, the length of the panels 20, 22 may also be modified to accommodate the variations in the spacing of the posts 16.

A parapet of the present invention, generally designated 250 and shown in FIGS. 29–32, can be located on a deck 12. The parapet 250 includes a set of upper panels 20 and lower panels 22 coupled to a plurality of posts 16. A plurality of intermediate bases 252 are spaced between adjacent posts 16. Each intermediate base 252 includes a support element 54 and a backing plate 254. The upper panels 20 and lower panels 22 are substantially identical to the panels 20, 22 of the median barrier 10.

The installation of one embodiment of a parapet 250 is shown in FIGS. 33–38, and is described in greater detail below. However, as with the case for the installation of the median barrier 10, the installation method described herein is merely an exemplary method, and other methods beyond those specifically described herein may be used without departing from the scope of the present invention.

Figure 32:
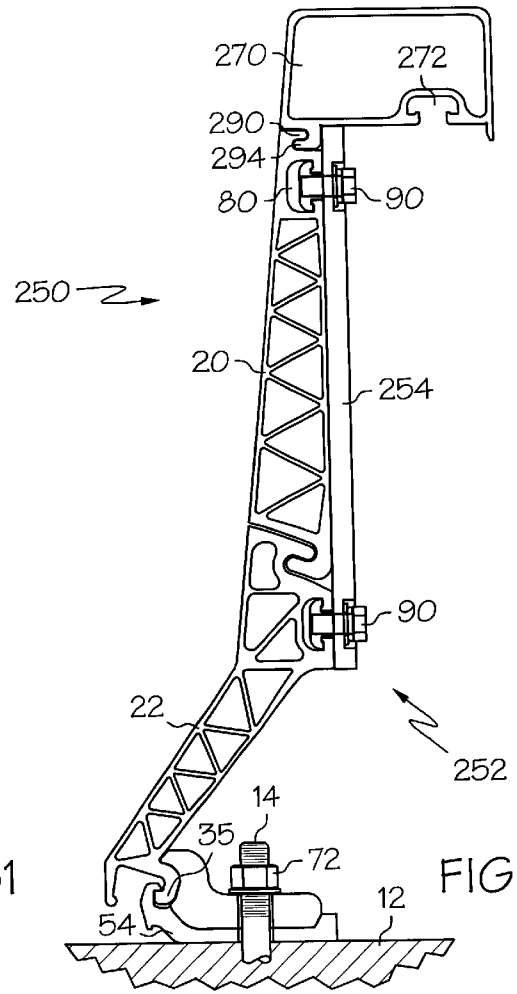
FIG. 32 is an end cross section view of the parapet of FIG. 29, taken along lines 32—32.
Figure 31:
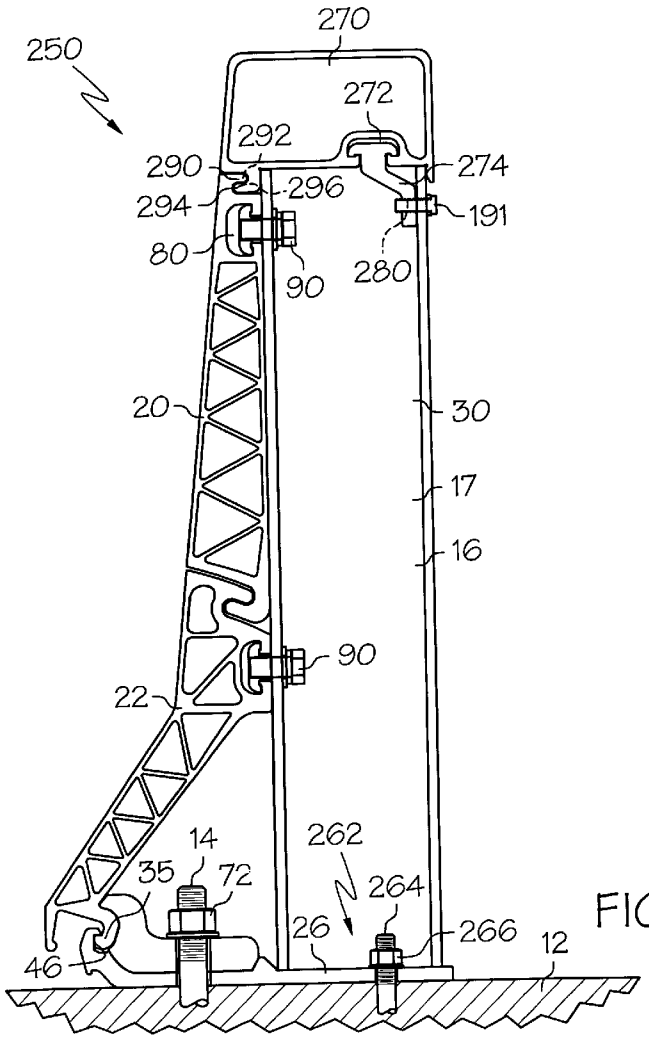
FIG. 31 is an end cross section view of the parapet of FIG. 29, taken along lines 31—31.
Figure 33:
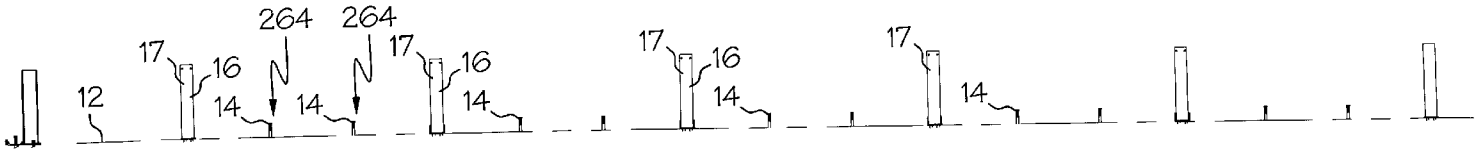
FIGS. 33–38 are a series of front views illustrating a preferred method for assembling the parapet of FIG. 29.
Figure 34:
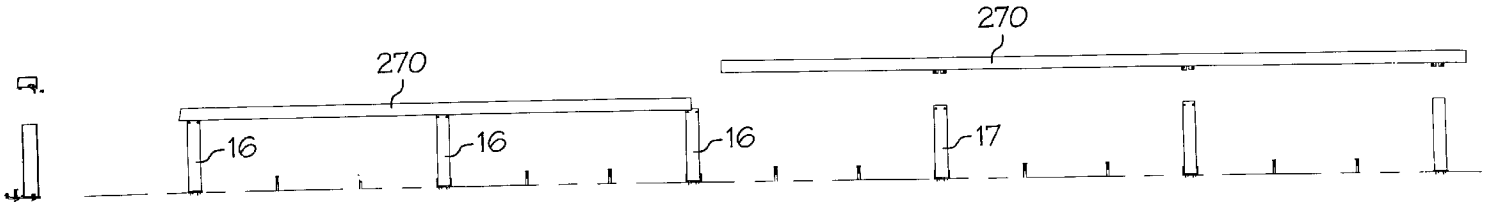
Figure 40:
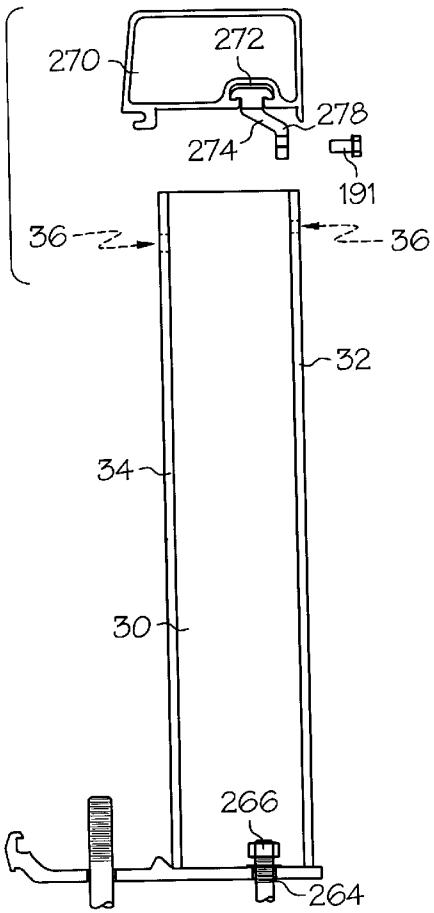
Figure 39:
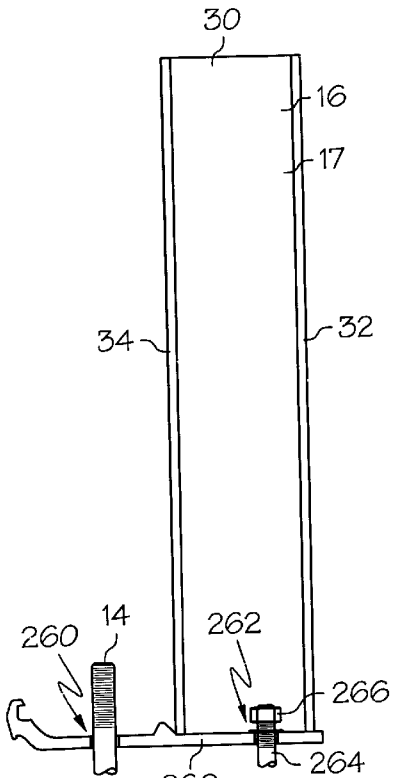

FIGS. 33–38 are a series of side views showing a preferred method for assembling the parapet, and FIGS. 39–44 are a series of end views that roughly correspond to the sequence of side views in FIGS. 33–38. As shown in FIG. 33, a plurality of post/base plate combinations 17 are located on the deck 12. As described earlier in the context of the parapet 10, the set of mounting bolts 14 extending upwardly from the deck 12 are passed through elongated slots 260 of the base plates 26 (FIG. 39) to attach the post/base plate combination 17 to the deck 12. The base plate 26 may include a rear elongated slot 262 to receive a rear mounting bolt 264 therethrough. Once sufficient posts/base plate combinations 17 have been mounted to the deck 12, fasteners 266 are loosely threaded onto each rear mounting bolt 264 to loosely couple the base plate/post combinations 17 to the deck 12. Next, as shown in FIGS. 34 and 40, a plurality of top caps 270 are mounted onto a number of posts 16. As best shown in FIGS. 31–32, each top cap 270 includes a channel 272 extending down the length of the top cap 270.

Figure 45:
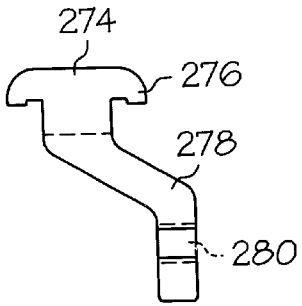
FIG. 45 is a end view of a top cap clamp used with the parapet of the present invention.
Figure 46:
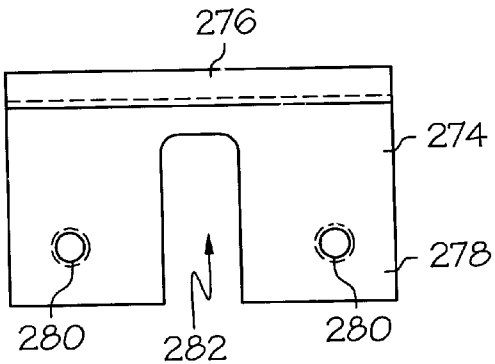
FIG. 46 is a front view of the top cap clamp of FIG. 45.
Figure 44:
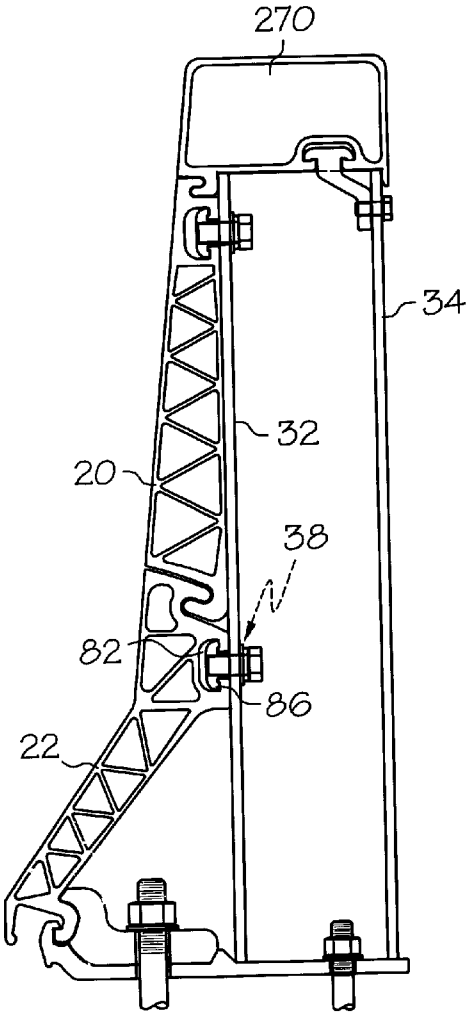

Next, a plurality of top cap clamps 274 are then slid into the channels 272 of the top caps 270. As shown in greater detail in FIGS. 45–46, each top cap clamp 274 includes an extruded head 276 that is shaped to slidingly fit within the channel 272 in a top cap 270, and a downwardly extending panel portion 278. The panel portion 278 includes a pair of opposed threaded holes 280 and a central slot 282 that is shaped to receive the central web 30 of a post 16 therein.

Thus, in order to mount a top cap 270 to three posts 16, as shown in FIG. 34, three top cap clamps 274 are slid into the channel 272 in the top cap 270, and top cap 270 is then lowered onto the posts 16 such that the central web 30 of each post 16 is received in the slot 282 of each top cap clamp 274. When the top cap clamp 274 received the central web 30 in the slot 282, each opposed hole 280 of the top cap clamp 274 is aligned over an upper hole 36 in the end flange 32 of post 16 (See FIG. 30). Fasteners 191 may then be passed through the upper holes 36 in the end flange 32 of the posts 16 and received in the holes 280 in the top cap clamps 274 to secure the top cap clamp 274, and thereby the top cap 270, to the posts 16 (see FIG. 31). Two or three adjacent top caps 270 are preferably mounted to the posts 16 in this manner, with the proper spacing between each adjacent top cap 270 being maintained. Similar to the use of the clamp bars 86 described below, the top cap clamps 274 couple the top caps 270 to the posts 16, but the top caps 270 are free to slide longitudinally relative to the top cap clamps 274 and posts 16, due to the fact that the head 276 of the top cap clamps 274 is free to slide in the channel 272.

Figure 35:
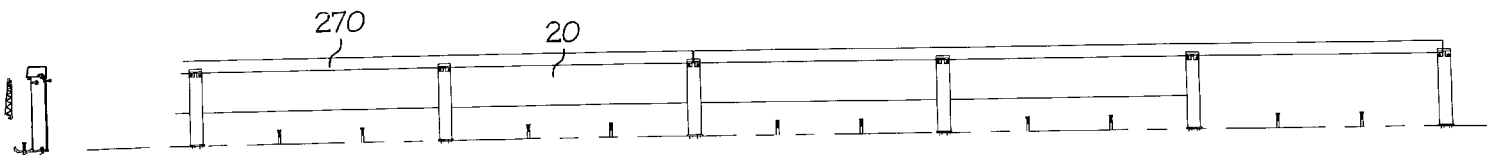
Figure 36:
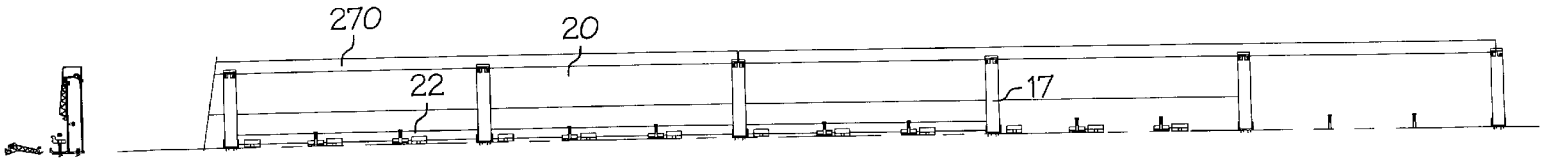

After the top caps 270 are coupled to the posts 16, the posts 16 should be evaluated to ensure straightness. The posts 16 may be adjusted to the desired position by sliding the base plates 26 and support elements 54 along their slots because the nuts 266 on the anchor bolts 264 have not yet been fully tightened. After the posts 16 are aligned, an upper panel 20 is placed on the top cap 270 as illustrated in FIGS. 35 and 40. An upper tab 290 in the upper panel 20 is fit into a laterally-extending groove 292 in the top cap 270, and a tab 294 of the top cap 270 is received in a groove 296 of the upper panel 20 to couple the upper panel 20 to the top cap 270 (FIGS. 31 and 32). A plurality of clamp bars 86 (i.e., ten in the illustrated embodiment) are then slid into the channel 80 in the upper panel 20. The set of clamp bars 86 are then slid along the channel 80 in the upper panel 20 until the holes 92 in the clamp bars 86 are aligned with the upper holes 36 in the flange 34 of posts 16. Fasteners 90 are then passed through the holes 92, 36 to secure the clamp bars 86 and the upper panel 20 to the post 16. Similar to the installation of the median barriers, the upstream edge of the upper panel 20 is preferably offset from the upstream edge of the first top cap 270 to improve the continuity of the parapet system 250.

Next, as shown in FIGS. 36–37 and 42–43, a lower panel 22 is then lowered into place such that the lower flange 35 is received in the notches 46, 60 of the base plates 26 and support elements 54 (See FIGS. 31, 32). Again, the lower panel 22 is preferably longitudinally offset in the downstream direction (i.e. by a spacing of one post) from the upstream edge of the upper panel 20 and longitudinally offset in the downstream direction (i.e. by a spacing of two posts) from the upstream edge of the top cap 270 to avoid an alignment of discontinuities. A plurality of clamp bars 86 are preferably slid into the channel 82 of the lower panel 22 before it is mounted in place.

Figure 37:
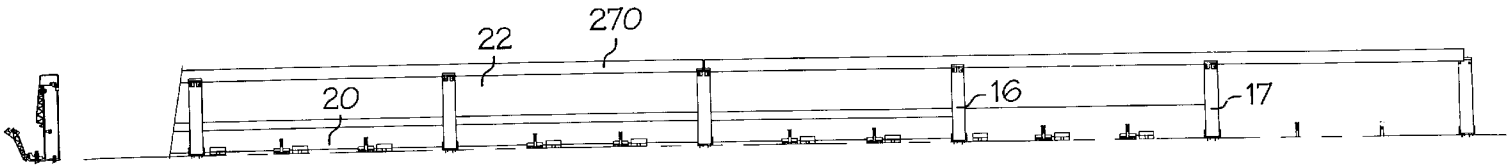
Figure 38:
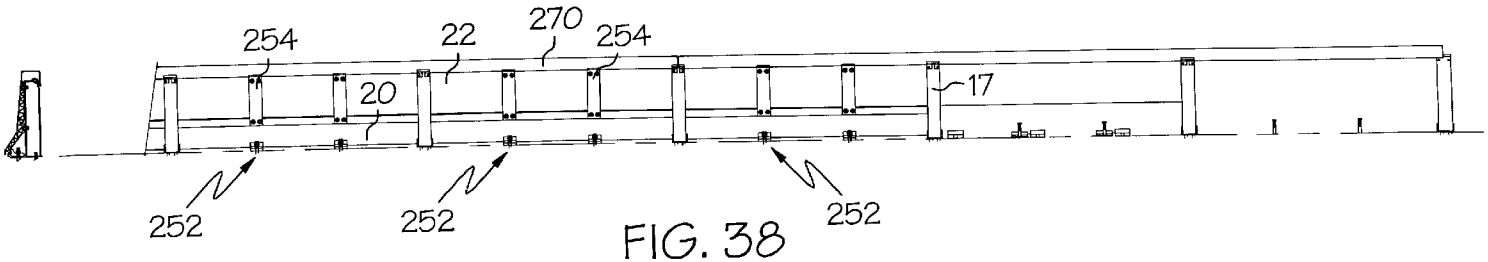
Figure 41:
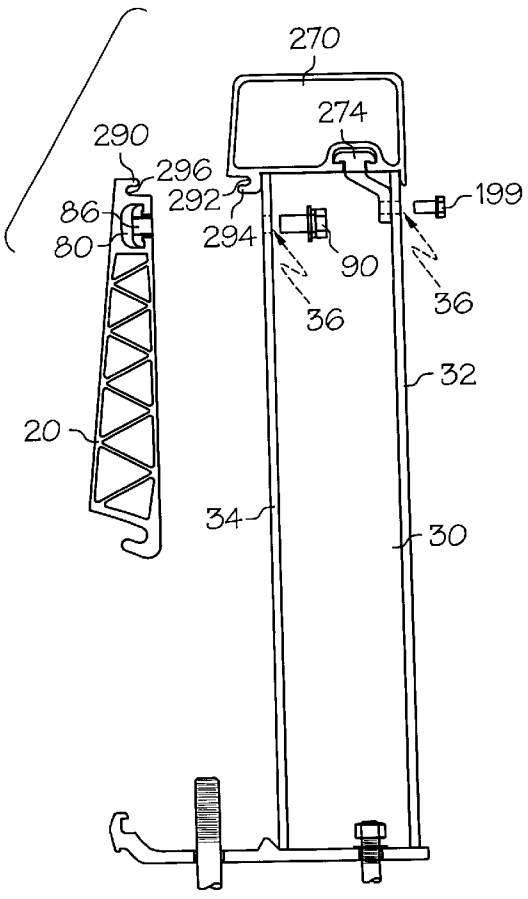
FIGS. 39–44 are a series of end cross sections illustrating a preferred method for assembling the parapet of the present invention, and roughly corresponding to FIGS. 33–38.
Figure 43:
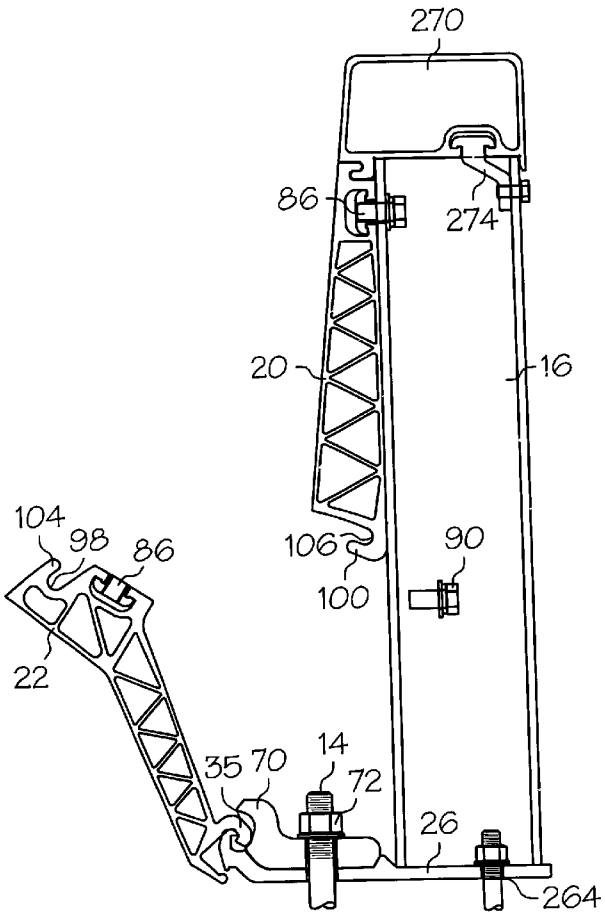
Figure 42:
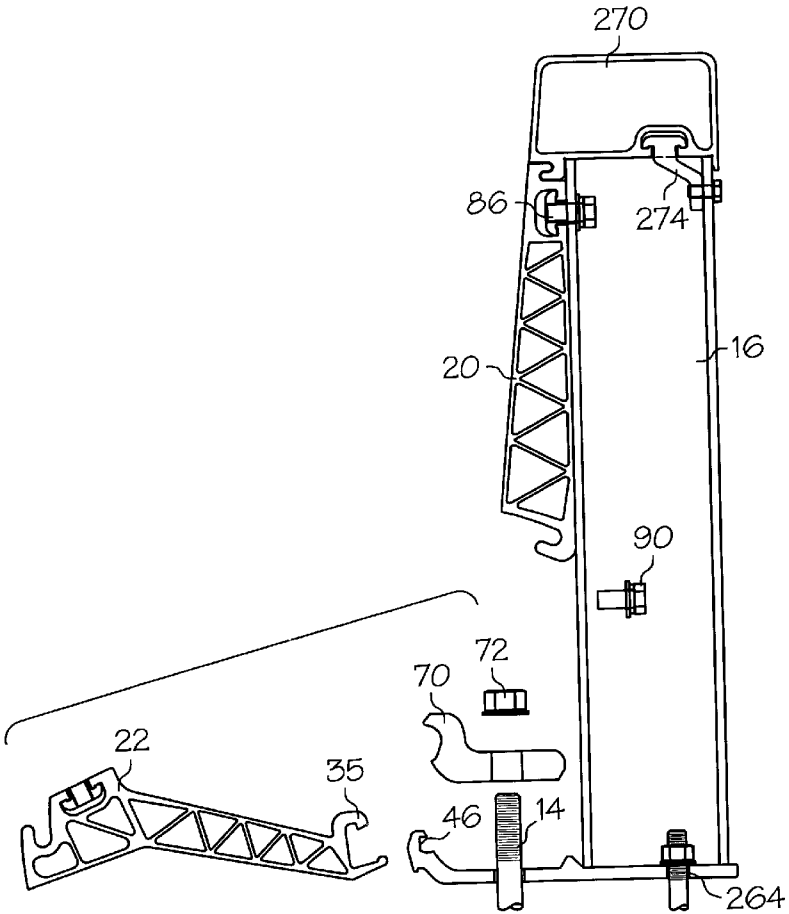

The lower panel 20 is lowered onto the posts 16 and support elements 54 such that the lower panel 20 rests against the deck 12 or base plate in its open position, as shown in FIGS. 37 and 43. If any toe clips 70 are not yet mounted over the bolts 14, the toe clips 70 are then placed on the mounting bolts 14 such that the toe clips 70 capture the lower ends of the lower panels 20 between the toe clips 70 and the base plates 26 or support elements 54.

The lower panel 22 is then rotated into position such that it is mated with the upper panel 20 (FIGS. 38 and 44) wherein the groove 98 of the lower panel 22 receives the tab 100 on the upper panel 20, and the tab 104 of the lower panel 22 is received in the groove 106 of the upper panel 20. The clamp bars 86 in the channel 82 of the lower panel 22 are then aligned with the lower holes 38 in flange 32 of the posts 16. Fasteners 90 are then passed through the aligned holes to couple the clamp bars 86 to the posts 16. As in the case of the installation of the median barrier, when the fasteners 90 are tightened down, the lower panel 22 is pulled into full mating engagement with the upper panel 20.

Next, a series of backing panels 254 (FIGS. 29 and 32) are then mounted on the back side of the panels 20, 22 above each of the support elements 54 to complete the intermediate bases 252. In order to couple the backing panel 254 to the panels 20, 22, fasteners 90 are passed through the backing panel 254 and received in clamp bars 86 located in the channels 80, 82 of the panels 20, 22.

Next, construction of the parapet 250 continues by locating another top cap 270, upper panel 20, and lower panel 22 onto the posts 16 at a downstream location. After these components are mounted, the nuts 72, 266 on all the mounting bolts 14, 264 and all the other fasteners and screws, except those in the last downstream panels, may be tightened. The panels adjacent the area that is fully secured are preferably connected with at least the minimal number of bolts and cap screws needed to maintain a safe work area. In this manner, the panels 20, 22 can remain loose to provide flexibility in lateral adjustments (i.e., via the elongated slots 260, 262) as subsequent components are mounted.

As shown in FIG. 51, the parapet 250 of the present invention sets up the force triangle or triangular truss HIJ analogous to the force triangle ABC of the median barrier 10 of FIG. 28. For example, when external forces 304 are applied to the parapet 250, the bending moment 310 of the system of FIG. 51 is significantly reduced compared to the bending moment 310 of the stem of FIG. 52 due to the triangular truss system HIJ. The triangular truss HIJ, which can be loosely analogized to a triangular system of bars pinned to each other at their ends, helps to convert the applied loads 304 into compression forces in the flange 34 of the post 16. Many of the other advantages described below in the context of the median barrier 10 are also present for the parapet 250, such as the flexibility in assembly, ability to bridge discontinuities in the deck, etc.

Figure 47A:
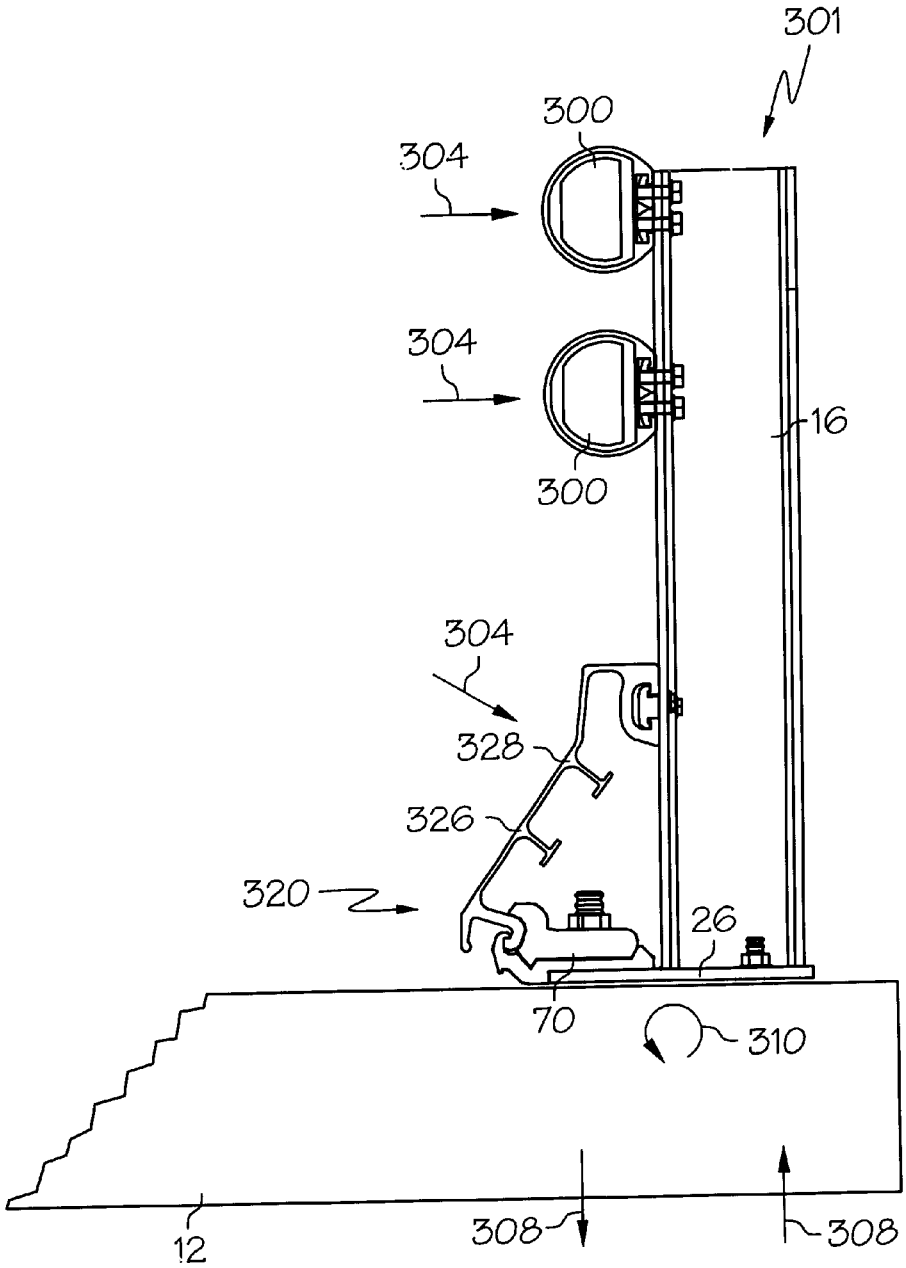
FIG. 47A is an end view of a guard rail in combination with an alternate embodiment of the parapet of the present invention mounted to a deck.

FIG. 47A illustrates an alternate embodiment of the parapet 320 in combination with a known, conventional guard rail 301 having a plurality of posts 16 and load bearing surfaces 300 coupled to the posts 16 (i.e., see FIG. 52 and the accompanying description). The parapet 320' of FIGS. 47 and 48 includes a plurality of lower panels 326, base plates 26, support elements 54 and toe clips 70, but lacks the upper panels 20 and top cap 270 of the standard parapet 250. Furthermore, the parapet 320' of FIG. 47A includes an alternate embodiment of the lower panel 20, shown as lower panel 326 in FIGS. 47A and 48B. The lower panel 326 includes an outer face 328, a pair of stiffening ribs 330, a heel 182, a channel 82 and a flange 23 having a lip 25. The lower panel 326 is preferably extruded, and therefore cheaper and easier to manufacture than a lower panel 22 due to the fact that the lower panel 326 lacks the voids or webs of lower panel 22. It should be understood that the lower panel 326 of FIGS. 47A and 47B can be used in any of the median barriers or parapets disclosed herein.

The embodiment of the parapet 250' of FIG. 47A may be used to retrofit an existing guard rail 301 by attaching the components of the parapet 250' to the existing posts 16 of an existing guard rail 301. Once assembled, the parapet 250' forms the force triangle HIJ of FIG. 51 for transmitting loads in the parapet 320', and therefore the parapet 320' significantly improves the load bearing characteristics of the guard rail 301 over the use of the guard rail 301 standing alone.

Furthermore, when a vehicle rides upon on the guard rail/parapet combination of FIG. 47A, the safety shape of the parapet 320' guides the vehicle upwardly and rotates the vehicle away from the post 16. The upward and rotational movement of the vehicle converts some of the lateral energy of the vehicle into a vertical component which can be absorbed by the vehicle springs. Thus, the parapet 320' dissipates energy of the vehicle before the vehicle reaches the guard rail 301, which enables the parapet/guard rail system to handle higher loads. Each of FIGS. 47A, 47B, 48A and 48B illustrate the reactive forces 308 and bending moment 310 when external forces 304 are applied to the median barriers illustrated therein.

Figure 47B:
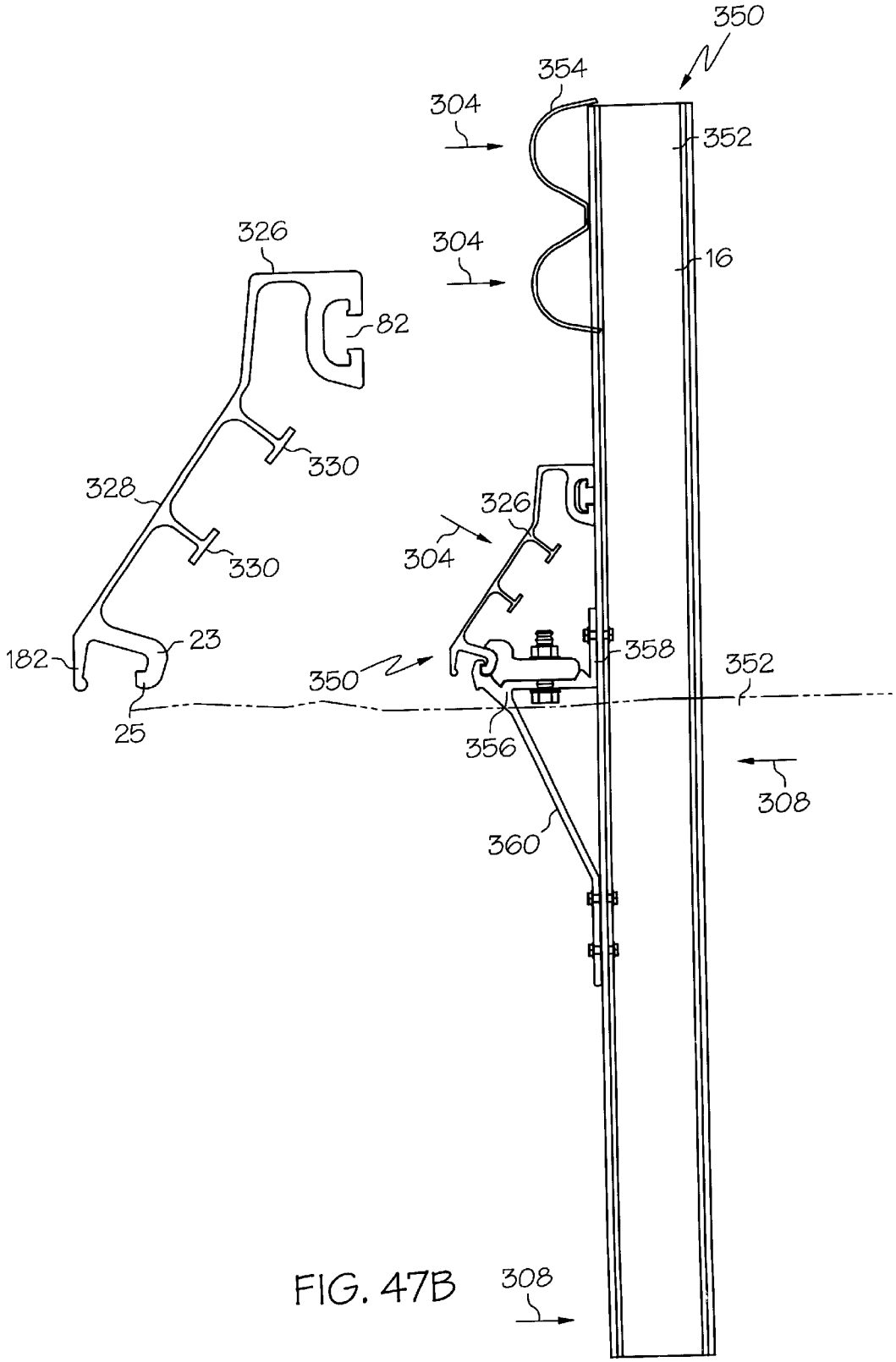
FIG. 47B is an end view of a guard rail in combination with an alternate embodiment of the parapet of the present invention mounted to the earth.

FIG. 47B illustrates an alternate parapet 350 coupled to an alternate guard rail 352 having a plurality of posts and curved load bearing surfaces 354. The posts 16 of the guard rail 352 are sunk into the earth 352. In this embodiment, the lower panel 326 is coupled to an alternate base plate 356. The base plate 356 includes an upwardly extending flange 358 that is coupled to the post 16 above ground level, and a downwardly extending flange 360 that is coupled to the post 16 significantly below ground level. This embodiment changes the reactive forces 308 as shown, and essentially eliminates the bending moment 310. It should be understood that the base plate 356 illustrated herein may be used with any embodiment of the median barrier or parapet disclosed herein.

Figure 48A:
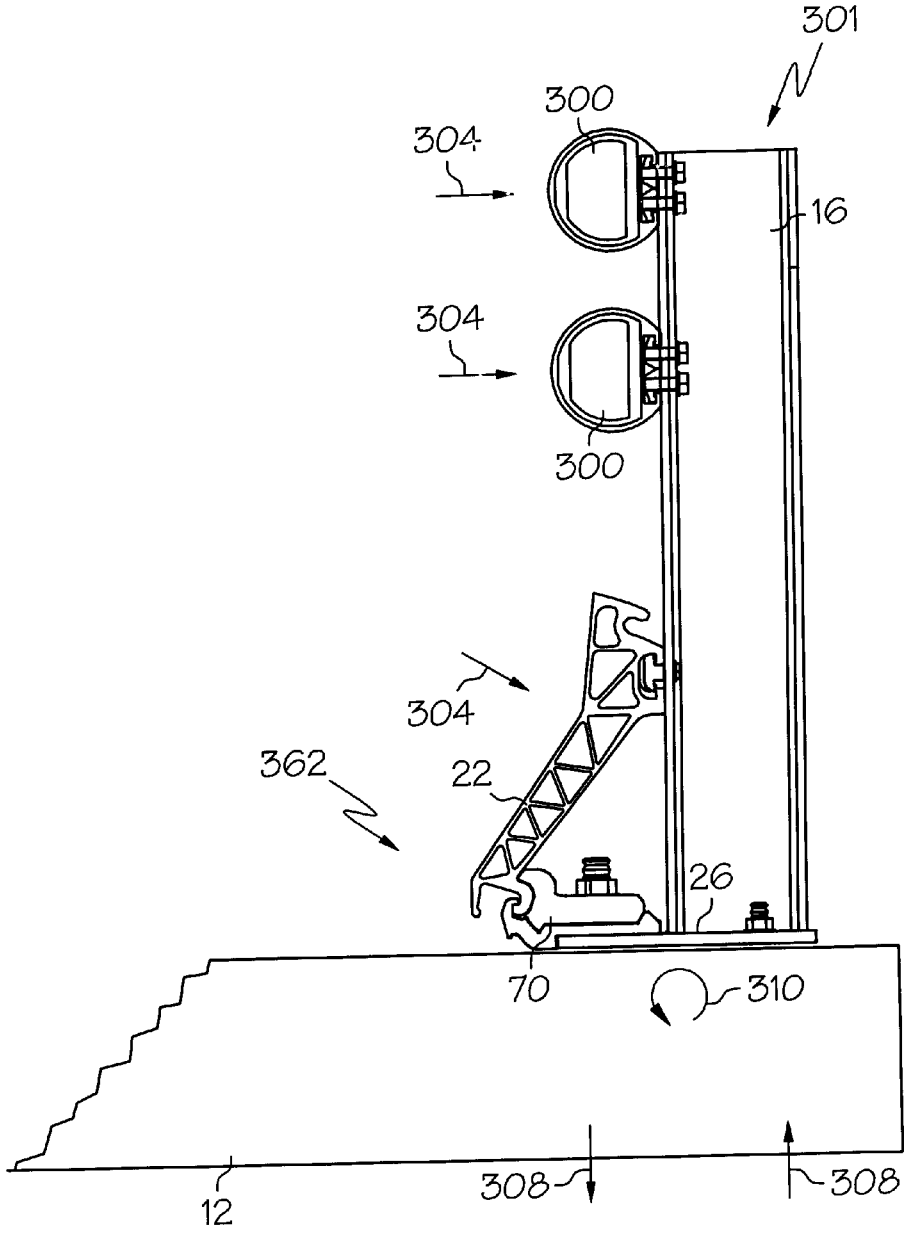
FIG. 48A is an end view of a guard rail in combination with an alternate embodiment of the parapet of the present invention mounted to a deck.

FIG. 48A illustrates a parapet 362 that is coupled to a guard rail 301. The parapet 362 of FIG. 48A is essentially identical to the parapet 320' of FIG. 47A, with the exception that the lower panel 326 of the embodiment of FIG. 47A has been replaced with a lower panel 22.

Figure 48B:
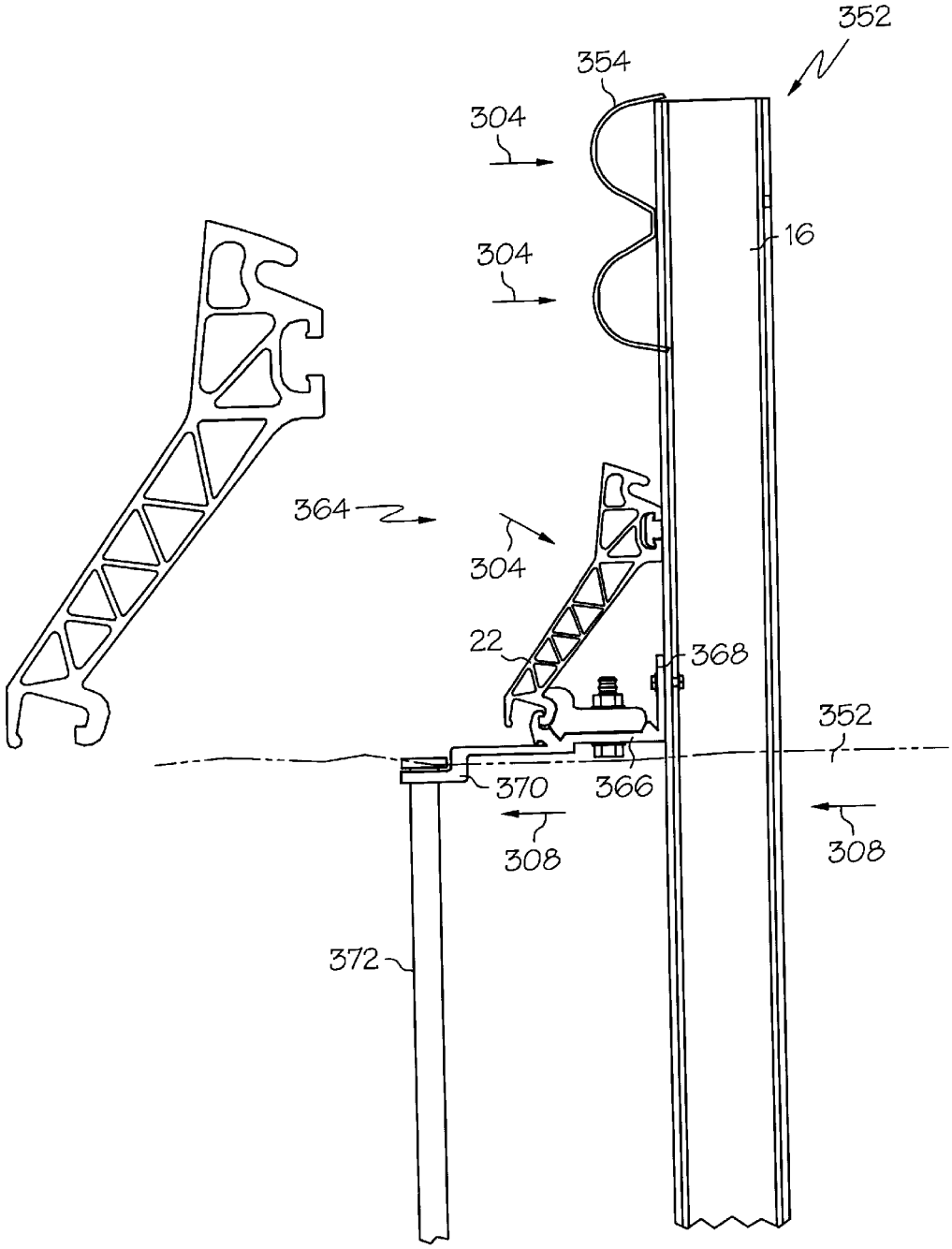
FIG. 48B is an end view of a guard rail in combination with an alternate embodiment of the parapet of the present invention mounted to the earth.
Figure 49:
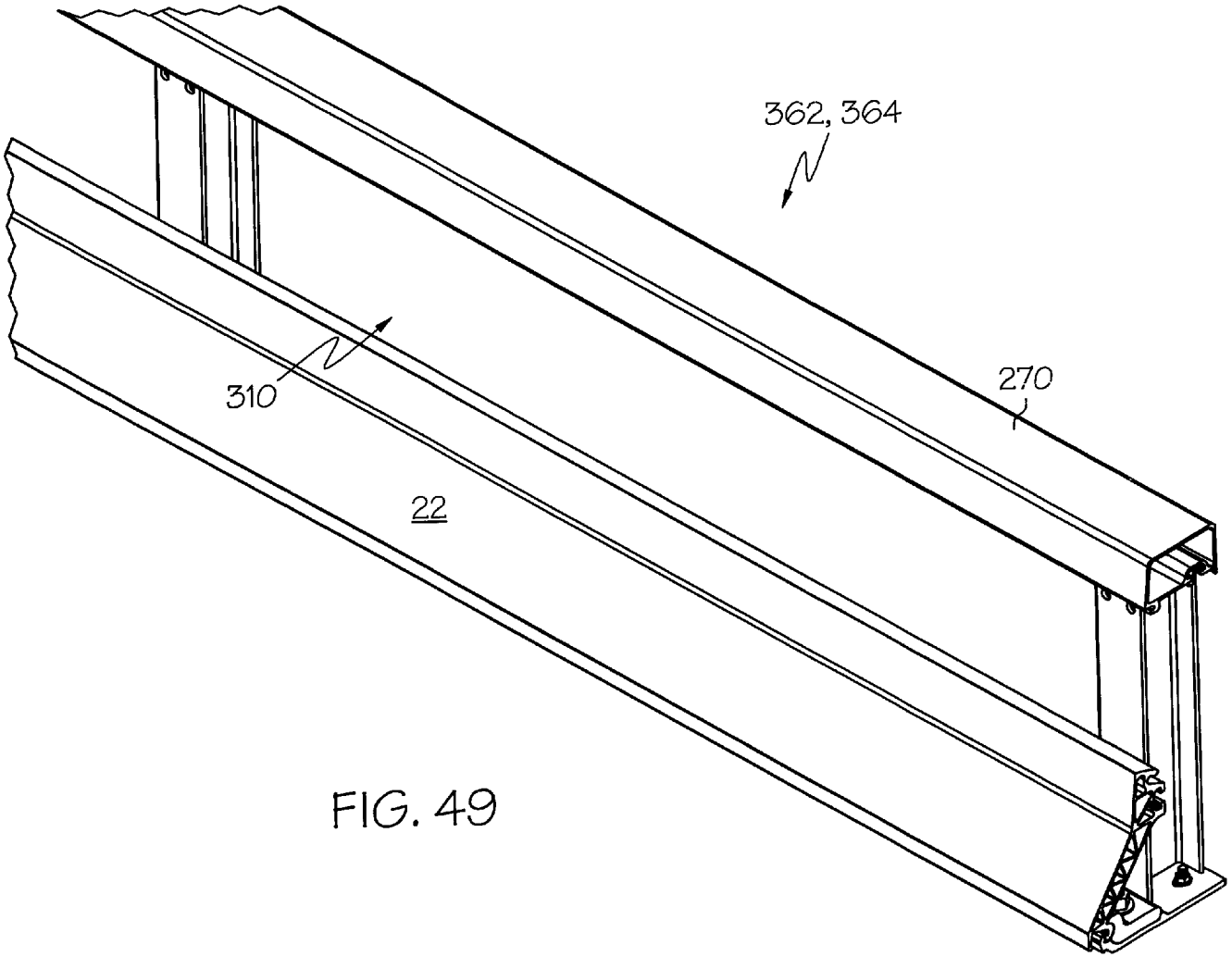
FIG. 49 is a perspective view of the parapet of FIGS. 48A and 48B.

FIG. 49 illustrates a parapet 364 that is coupled to a guard rail 352. The parapet includes a lower panel 22 coupled to a post 16 by a base plate 366. The base plate 366 includes a upwardly extending flange 368 coupled to the post 16, and an outwardly extending flange 370. The outwardly extending flange 370 is coupled to an anchor rod 372 that is sunk into the earth 352. The anchor rod 372 provides a resistive force to prevent the base plate 366 from moving laterally or longitudinally relative to the post. Thus, when forces 304 are applied to the parapet 364 of FIG. 48B, resistive forces 308 are applied to the post 16 and anchor rod 372. It should be understood that the base plate 366 and anchor rod 372 of FIG. 48B may be used with any embodiment of the median barrier or parapet disclosed herein.

FIG. 49 illustrates the median barrier 362, 364 of FIGS. 48A and 48B with the guard rail 301, 352 removed. As shown in FIG. 49, the parapet 362, 364 may include a top cap 270, and the guard rail 301, 352 may in this case be located in the space 310 located between the lower panels 22 and top caps 270 (i.e. the space vacated by the upper panels 20). Of course, the parapets 320', 350, 362, 364 of FIGS. 47A, 47B, 48A, 48B and 49 may be used with nearly any component located above the lower panels 22 (in the embodiments of FIGS. 47A, 47B, 48A, 48B) or in the space 310 (in the embodiment of FIG. 49) to improve the load-bearing characteristics of such a component.

All of the structural components of the median barrier and parapet of the present invention are preferably made of metal, such as extruded aluminum, although various other materials may be used without departing from the scope of the invention.

Having described the invention in detail and be reference to the preferred embodiments thereof, it will be apparent that modifications and variations are possible without departing from the scope of the invention.

What is claimed is:

1. A parapet for mounting on a deck and resisting applied loads comprising:

a generally continuous base plate located on said deck;

a post coupled to said base plate and extending generally upwardly from said deck; and a lower panel extending from base plate to said post such that said post, said base plate and said lower panel form a triangular truss for resisting applied loads, wherein said base plate is a generally flat panel that is coupled to an end surface of said post, said base plate being coupled to said deck.

2. The parapet of claim 1 wherein said base plate, said post and said lower panel form a triangular pinned-bar connection.

3. The parapet of claim 2 wherein the connection between said lower panel and said base plate is tightly toleranced such that when a force is applied to said lower panel said lower panel applies no or very little bending forces to said post.

4. The parapet of claim 1 wherein said lower panel is coupled to said base plate.

5. The parapet of claim 1 wherein said base plate is integral.

6. A parapet for mounting on a deck and resisting applied loads comprising:

a generally continuous base plate located on said deck;

a post coupled to said base plate and extending generally upwardly from said deck; and a lower panel extending from base plate to said post such that said post, said base plate and said lower panel form a triangular truss for resisting applied loads, wherein said lower panel is coupled to said post and said base plate such that said lower panel is restrained from moving vertically and transversely relative to said post and said base plate but said lower panel can slide longitudinally relative to said base plate and said post.

7. The parapet of claim 6 wherein said lower panel includes a channel formed therein and said post includes an opening, and wherein said lower panel is coupled to said post by a clamp bar slidably received in said channel and a fastener passed through said opening and received in said clamp bar.

8. A parapet for mounting on a deck and resisting applied loads comprising:

a generally continuous base plate located on said deck;

a post coupled to said base plate and extending generally upwardly from said deck; and a lower panel extending from base plate to said post such that said post, said base plate and said lower panel form a triangular truss for resisting applied loads, wherein said base plate is coupled to said deck by a fastener, and wherein said lower panel is pivotable about its lower end relative to said base plate and said post such that said lower panel can be pivoted out of a vertical plane of said fastener to provide access to said fastener.

9. The parapet of claim 8 further comprising a toe clip removably coupled to said base plate such that said toe clip captures said lower end of said lower panel between said toe clip and said base plate to guide the pivoting of said lower panel.

10. The parapet of claim 9 wherein said toe clip includes a curved outer surface and wherein said lower end of said lower panel includes a curved outer surface such that said curved outer surface of said lower end slides along said curved outer surface of said toe clip when said lower panel is pivoted.

11. A parapet for mounting on a deck and resisting applied loads comprising:

a generally continuous base plate located on said deck;

a post coupled to said base plate and extending generally upwardly from said deck; and a lower panel extending from base plate to said post such that said post, said base plate and said lower panel form a triangular truss for resisting applied loads, wherein a lower end of said lower panel and an outer edge of said base plate include interlocking profiles such that said lower end of said lower panel is slidingly and rotationally received in said outer edge of said base plate.

12. A parapet for mounting on a deck and resisting applied loads comprising:

a generally continuous base plate located on said deck;

a post coupled to said base plate and extending generally upwardly from said deck; and a lower panel extending from base plate to said post such that said post, said base plate and said lower panel form a triangular truss for resisting applied loads, wherein said panel is received on said base plate, and wherein said base plate includes a ridge that receives a lower end of said lower panel to automatically locate said lower end a predetermined distance from said post.

13. A parapet for mounting on a deck and resisting applied loads comprising:

a generally continuous base plate located on said deck;

a post coupled to said base plate and extending generally upwardly from said deck;

a lower panel extending from base plate to said post such that said post, said base plate and said lower panel form a triangular truss for resisting applied loads; and a support element coupled to said deck and receiving a lower end of said lower panel therein to prevent said lower end from moving transversely relative to said post.

14. A parapet for mounting on a deck and resisting applied loads comprising:

a generally continuous base plate located on said deck;

a post coupled to said base plate and extending generally upwardly from said deck;

a lower panel extending from base plate to said post such that said post, said base plate and said lower panel form a triangular truss for resisting applied loads; and an upper panel located on top of and coupled to said lower panel, said upper panel being coupled to said post, wherein said upper panel and said lower panel each include interlocking portions to lockingly couple said upper panel to said lower panel.

15. The parapet of claim 14 wherein said lower panel includes an upstream edge and said upper panel includes an upstream edge, and wherein the upstream edge of said upper panel is offset from said upstream edge of said lower panel.

16. A parapet for mounting on a deck and resisting applied loads comprising:

a generally continuous base plate located on said deck;

a post coupled to said base plate and extending generally upwardly from said deck;

a lower panel extending from base plate to said post such that said post, said base plate and said lower panel form a triangular truss for resisting applied loads;

an upper panel located on top of and coupled to said lower panel, said upper panel being coupled to said post; and a top cap coupled to said upper panel and located over said post.

17. A parapet for mounting on a deck and resisting applied loads comprising:

a generally continuous base plate located on said deck;

a post coupled to said base plate and extending generally upwardly from said deck; and a lower panel extending from base plate to said post such that said post, said base plate and said lower panel form a triangular truss for resisting applied loads, wherein said base plate includes at least one bolt receiving hole, and wherein said base plate is coupled to said deck by a bolt that extends upwardly from said deck and is received through said bolt receiving hole, and wherein said bolt receiving hole is elongate to enable said bolt to slide within said bolt receiving hole.

18. A parapet for mounting on a deck and resisting applied loads comprising:

a generally continuous base plate located on said deck;

a post coupled to said base plate and extending generally upwardly from said deck; and a lower panel extending from base plate to said post such that said post, said base plate and said lower panel form a triangular truss for resisting applied loads, wherein said lower panel includes a channel formed therein and said post includes an opening, and wherein said lower panel is coupled to said post by a clamp bar slidably received in said channel of said lower panel and a fastener passed through said opening of said spacer and received in said clamp bar.

19. A median barrier for mounting on a deck and resisting applied loads comprising:

a generally continuous base plate located on said deck; and a pair of opposed lower panels located on said base plate and angled toward each other, said lower panels being directly or indirectly coupled together and to said deck to form a triangular truss for resisting applied loads, wherein both of said lower panels are coupled to a spacer, and wherein each lower panel includes a channel formed therein and said spacer includes at least two openings, and wherein each lower panel is coupled to said spacer by a clamp bar slidably received in the channel of said lower panel and a fastener passed through said one of said openings of said spacer and received in the associated clamp bar.

20. The median barrier of claim 19 wherein said base plate and a lower end of each of said lower panels include interlocking profiles such that said lower end of each lower panel can be slidingly and rotationally received adjacent an outer edge of said base plate.

21. The median barrier of claim 19 wherein said base plate and said opposed lower panels form a triangular pinned-bar connection.

22. The median barrier of claim 19 wherein the connection between said lower panels and said base plate are tightly toleranced such that when a force is applied to one of said lower panels said lower panel apply no or very little bending forces to said spacer.

23. The median barrier of claim 19 wherein said spacer is a beam coupled to each of said lower panels.

24. The median barrier of claim 23 wherein said beam is coupled to said deck.

25. The median barrier of claim 19 wherein said beam is coupled to said base plate, and wherein said base plate is coupled to said deck.

26. The median barrier of claim 19 wherein each channel includes a throat portion and each clamp bar includes a head portion that is larger than said throat portions such that said clamp bar can slide longitudinally in said channels, but can not be laterally pulled out of said channels.

27. The median barrier of claim 19 wherein each lower panel is coupled to said spacer and said base plate such that each lower panel is restrained from moving vertically and transversely relative to said spacer and said base plate but each lower panel can slide longitudinally relative to said spacer and said base plate.

28. The median barrier of claim 19 wherein each panel is received on said base plate, and wherein said base plate includes a pair of ridges, each ridge receiving a lower end of one of said lower panel to automatically locate said lower ends of said lower panels a predetermined distance from each other.

29. The parapet of claim 19 wherein each lower panel is coupled to said base plate.

30. The parapet of claim 19 wherein said base plate is integral.

31. A median barrier for mounting on a deck and resisting applied loads comprising:

a generally continuous base plate located on said deck; and a pair of opposed lower panels located on said base plate and angled toward each other, said lower panels being directly or indirectly coupled together and to said deck to form a triangular truss for resisting applied loads, wherein each lower panel includes a lower end coupled to said base plate, and wherein said base plate is coupled to said deck by a pair of fasteners, and wherein each lower panel is pivotable about its lower end such that each lower panel can be pivoted out of a vertical plane of one of said fastener to provide access to said fastener.

32. The median barrier of claim 31 further comprising a pair of toe clips removably coupled to said base plate such that each toe clip captures said lower end of one of said lower panels between said toe clip and said base plate to guide the pivoting of said lower panel.

33. The median barrier of claim 32 wherein each toe clip includes a curved outer surface and wherein said lower end of each lower panel includes a curved outer surface such that the curved outer surfaces of said lower panel slide along said curved outer surfaces of said toe clips when each lower panel is pivoted.

34. A median barrier for mounting on a deck and resisting applied loads comprising:

a generally continuous base plate located on said deck;

a pair of opposed lower panels located on said base plate and angled toward each other, said lower panels being directly or indirectly coupled together and to said deck to form a triangular truss for resisting applied loads;

a pair of support elements coupled to said deck, each support element receiving a lower end of one of said lower panels therein to prevent said lower ends from moving away from each other; and a pair of toe clip, each toe clip being located on one of said support elements and over a lower end of one of said lower panels to maintain the associated lower panel between said toe clip and said support element.

35. A median barrier for mounting on a deck and resisting applied loads comprising:

a generally continuous base plate located on said deck;

a pair of opposed lower panels located on said base plate and angled toward each other, said lower panels being directly or indirectly coupled together and to said deck to form a triangular truss for resisting applied loads; and a pair of upper panels, each upper panel being located on top of and coupled to one of said lower panels, wherein each upper panel and each lower panel include interlocking portions to lockingly couple each upper panel to its associated lower panel, and wherein each of said upper and lower panels are coupled to a spacer, and wherein said spacer includes a plurality of openings and each upper panel includes a channel formed therein, and wherein each upper panel is coupled to said spacer by a clamp bar slidably received in said channel and a fastener passed through said one of said openings of said spacer and received in the associated clamp bar.

36. A median barrier for mounting on a deck and resisting applied loads comprising:

a generally continuous base plate located on said deck; and a pair of opposed lower panels located on said base plate and angled toward each other, said lower panels being directly or indirectly coupled together and to said deck to form a triangular truss for resisting applied loads;

a pair of upper panels, each upper panel being located on top of and coupled to one of said lower panels, and wherein each upper panel and each lower panel include interlocking portions to lockingly couple each upper panel to its associated lower panel;

a top cap coupled to said upper panels; and a pair of side panels, each side panel being coupled to one of said upper panels and to said top cap, wherein each of said upper panels and said top cap includes a longitudinal groove formed therein, and wherein each side panel includes a pair of flanges, one of said flanges being shaped to be received in a groove of one of said upper panels, the other of said flanges being shaped to be received in one of said grooves of said top cap to thereby couple each side panel to said upper panels and said top cap.

37. The median barrier of claim 36 wherein the distance between each groove of said upper panel and an associated groove of said top cap is greater than the distance between said flanges of each side panel when said side panels are not coupled to said upper panels and said top cap such that each side panel is pulled into a state of tension when coupled to one of said upper panels and said top cap.

38. A median barrier for mounting on a deck and resisting applied loads comprising:

a generally continuous base plate located on said deck;

a pair of opposed lower panels located on said base plate and angled toward each other, said lower panels being directly or indirectly coupled together and to said deck to form a triangular truss for resisting applied loads; and a pair of upper panels, each upper panel being located on top of and coupled to one of said lower panels, and wherein each upper panel and each lower panel include interlocking portions to lockingly couple each upper panel to its associated lower panel, and wherein each lower panel includes an upstream edge and each upper panel includes an upstream edge, and wherein the upstream edge of each upper panel is offset from the upstream edge of each associated lower panel.

39. A median barrier for mounting on a deck and resisting applied loads comprising:

a generally continuous base plate located on said deck; and a pair of opposed lower panels located on said base plate and angled toward each other, said lower panels being directly or indirectly coupled together and to said deck to form a triangular truss for resisting applied loads, wherein said base plate includes at least one bolt receiving hole, and wherein said base plate is coupled to said deck by at least one bolt that extends upwardly from said deck and is received through said bolt receiving hole, and wherein said bolt receiving hole is elongate to enable said bolt to slide within said bolt receiving hole.

40. A median barrier for mounting on a deck and resisting applied loads comprising:

a generally continuous base plate located on said deck; and a pair of opposed lower panels located on said base plate and angled toward each other, said lower panels being directly or indirectly coupled together and to said deck to form a triangular truss for resisting applied loads, wherein said base plate includes a pair of opposed notches, each notch being shaped and located to receive the lower end of one of said lower panels therein.

41. A method for assembling a parapet on a deck comprising the steps of:

providing a post structure comprising a post and a generally continuous base plate coupled to an end of said post;

coupling said post structure to said deck such that said post extends generally upwardly from said deck; and coupling a lower panel to said post structure such that said lower panel extends from base plate to said post such that said post, said base plate and said lower panel form a triangular truss for resisting applied loads, wherein said lower panel includes a channel and said post structure includes an opening, and wherein second coupling step includes locating a clamp bar in said channel, sliding said clamp bar in said channel until said clamp bar is aligned with said opening, and passing a fastener through said opening and into said clamp bar.

42. A method for assembling a median barrier on a deck comprising the steps of:

coupling a generally continuous base plate to said deck;

locating a pair of opposed lower panels on said base plate such that a lower end of each panel is received in said base plate; and directly or indirectly coupling said lower panels to each other such that said lower panels and said base plate form a triangular truss for resisting applied loads, wherein said coupling step includes coupling each lower panel to a spacer, and wherein each lower panel includes a channel and said spacer includes at least two openings, and wherein each lower panel is coupled to said spacer by locating a clamp bar in said channel, sliding said clamp bar in said channel until said clamp bar is aligned with one of said openings, and passing a fastener through said opening and into said clamp bar.

43. A method for assembling a parapet on a deck comprising the steps of:

providing a post structure comprising a post and a generally continuous base plate coupled to an end of said post;

coupling said post structure to said deck such that said post extends generally upwardly from said deck; and coupling a lower panel to said post structure such that said lower panel extends from base plate to said post such that said post, said base plate and said lower panel form a triangular truss for resisting applied loads, wherein said second coupling step includes placing a lower end of said lower panel on said base plate and locating a toe clip on top of said base plate such that said lower end of said lower panel is captured between said toe clip and said base plate.

44. A method for assembling a parapet on a deck comprising the steps of:

providing a post structure comprising a post and a base plate coupled to an end of said post;

coupling said post structure to said deck such that said post extends generally upwardly from said deck;

coupling a lower panel to said post structure such that said lower panel extends from base plate to said post such that said post, said base plate and said lower panel form a triangular truss for resisting applied loads, wherein said second coupling step includes placing a lower end of said lower panel on said base plate and locating a toe clip on top of said base plate such that said lower end of said lower panel is captured between said toe clip and said base plate; and pivoting said lower panel about its lower end to provide access to said base plate.

45. The method of claim 44 further comprising the step of adding a support element to limit the lateral movement of said lower panel, said adding step including coupling said support element to said deck such that said support element is located below a lower edge of said panel; locating a toe clip on top of said support element such that said lower edge is captured between said toe clip and said support element; coupling said toe clip to said base plate; pivoting said lower panel such that said lower panel is located adjacent to said post; and coupling said lower panel to said post.

46. A method for assembling a median barrier on a deck comprising the steps of:

coupling a generally continuous base plate to said deck;

locating a pair of opposed lower panels on said base plate such that a lower end of each panel is received in said base plate;

directly or indirectly coupling said lower panels to each other such that said lower panels and said base plate form a triangular truss for resisting applied loads, wherein said first coupling step includes placing said lower end of each lower panel on said base plate and coupling a pair of toe clips to said base plate such that said lower end of each lower panel is captured between one of said toe clips and said base plate; and pivoting at least one of said lower panels about its lower end to provide access to said base plate.

47. A method for assembling a median barrier on a deck comprising the steps of:

coupling a generally continuous base plate to said deck;

locating a pair of opposed lower panels on said base plate such that a lower end of each panel is received in said base plate;

directly or indirectly coupling said lower panels to each other such that said lower panels and said base plate form a triangular truss for resisting applied loads, and wherein said first coupling step includes placing said lower end of each lower panel on said base plate and coupling a pair of toe clips to said base plate such that said lower end of each lower panel is captured between one of said toe clips and said base plate;

pivoting at least one of said lower panels about its lower end to provide access to said base plate; and adding a support element to limit the lateral movement said one of said lower panels, said adding step including coupling said support element to said deck such that said support element is located below a lower edge of said lower panel;

coupling said toe clip to said support element such that said lower edge is captured between said toe clip and said support element;

pivoting said lower panel such that said lower panel is located adjacent to said other lower panel; and directly or indirectly coupling said lower panel to said other lower panel.

* * * * *